US010485360B2

(12) United States Patent
Keeder

(10) Patent No.: US 10,485,360 B2
(45) Date of Patent: Nov. 26, 2019

(54) DUAL MERCHANDIZING CASE

(71) Applicant: Kellogg Company, Battle Creek, MI (US)

(72) Inventor: Karen Keeder, Kalamazoo, MI (US)

(73) Assignee: KELLOGG COMPANY, Battle Creek, MI (US)

( * ) Notice: Subject to any disclaimer, the term of this patent is extended or adjusted under 35 U.S.C. 154(b) by 691 days.

(21) Appl. No.: 15/158,092

(22) Filed: May 18, 2016

(65) Prior Publication Data

US 2016/0338509 A1 Nov. 24, 2016

Related U.S. Application Data

(60) Provisional application No. 62/163,537, filed on May 19, 2015.

(51) Int. Cl.

| | |
|---|---|
| ***A47F 3/02*** | (2006.01) |
| ***B65D 5/72*** | (2006.01) |
| ***A47F 3/00*** | (2006.01) |

(52) U.S. Cl.

CPC ..... *A47F 3/02* (2013.01); *A47F 3/004* (2013.01); *B65D 5/725* (2013.01)

(58) Field of Classification Search

USPC ..... 229/121, 122, 122.1, 160.2, 242; 206/736, 772, 773, 774

See application file for complete search history.

(56) References Cited

U.S. PATENT DOCUMENTS 3,207,380 A * 9/1965 Hennessey ..... B65D 5/744 222/183
3,708,109 A * 1/1973 Rosenburgh, Jr. ..... B65D 5/705 229/122
4,004,691 A * 1/1977 Wihksne ..... B65D 5/4229 206/459.1
4,577,799 A * 3/1986 Oliff ..... B65D 5/10 206/155

(Continued)

FOREIGN PATENT DOCUMENTS

| | | |
|---|---|---|
| CA | 2785111 | 2/2013 |
| WO | 2005/110866 | 11/2005 |

OTHER PUBLICATIONS

PCT/US2016/033107 International Search Report dated Aug. 26, 2016.

*Primary Examiner* — Jacob K Ackun
(74) *Attorney, Agent, or Firm* — Honigman LLP; Kathryn D. Doyle, Esq.; Jonathan P. O'Brien

(57) ABSTRACT

A merchandizing case may include a housing having first, second, third, fourth, fifth, and sixth walls. The first wall may oppose and may be substantially parallel to the second wall, the third wall may oppose and may be substantially parallel to the fourth wall, and the fifth wall may oppose and may be substantially parallel to the sixth wall. The housing may have an interior volume defined by the first wall, the second wall, the third wall, the fourth wall, the fifth wall, and the sixth wall. A first dispensing opening may be formed in the first wall to provide access to the interior volume and is usable when the housing is supported by the fourth wall. A second dispensing opening may be formed in the second wall to provide access to the interior volume and is usable when the housing is supported by the second wall.

20 Claims, 17 Drawing Sheets

(56) References Cited

U.S. PATENT DOCUMENTS 4,865,187 A * 9/1989 Zulauf ..... B65D 5/54 206/772
6,062,424 A * 5/2000 Simile-Gravina ..... A47F 1/08 206/746
6,866,188 B2 3/2005 Harrelson
6,932,265 B2 * 8/2005 Sax ..... B65D 5/16 206/736
7,475,777 B2 * 1/2009 Fung ..... B65D 71/36 206/427
7,648,048 B2 1/2010 Smith
7,743,972 B2 * 6/2010 Fogle ..... B65D 71/36 221/302
7,757,934 B2 * 7/2010 Coltri-Johnson ..... B65D 71/36 229/122
8,752,708 B2 * 6/2014 Keefe ..... B65D 5/5445 206/736
2003/0146130 A1 * 8/2003 Kanter ..... B65D 5/001 206/774
2004/0094452 A1 * 5/2004 Scott, III ..... B65D 5/10 206/769
2004/0099719 A1 * 5/2004 Shadrach, III ..... B65D 5/18 229/116.1
2005/0269243 A1 * 12/2005 Andersen ..... B65D 5/52 206/736
2007/0080199 A1 * 4/2007 Sutherland ..... B65D 71/36 229/122.1
2007/0295792 A1 * 12/2007 Zammit ..... B65D 71/36 229/122
2008/0302864 A1 * 12/2008 Smith ..... B65D 71/36 229/122.1
2010/0044420 A1 2/2010 Brand et al.
2010/0044421 A1 * 2/2010 Learn ..... B65D 5/542 229/121
2011/0049227 A1 * 3/2011 Gretzinger ..... B65D 5/541 229/117.12
2015/0053754 A1 * 2/2015 Bogdziewicz ..... B65D 5/725 229/122.1

* cited by examiner

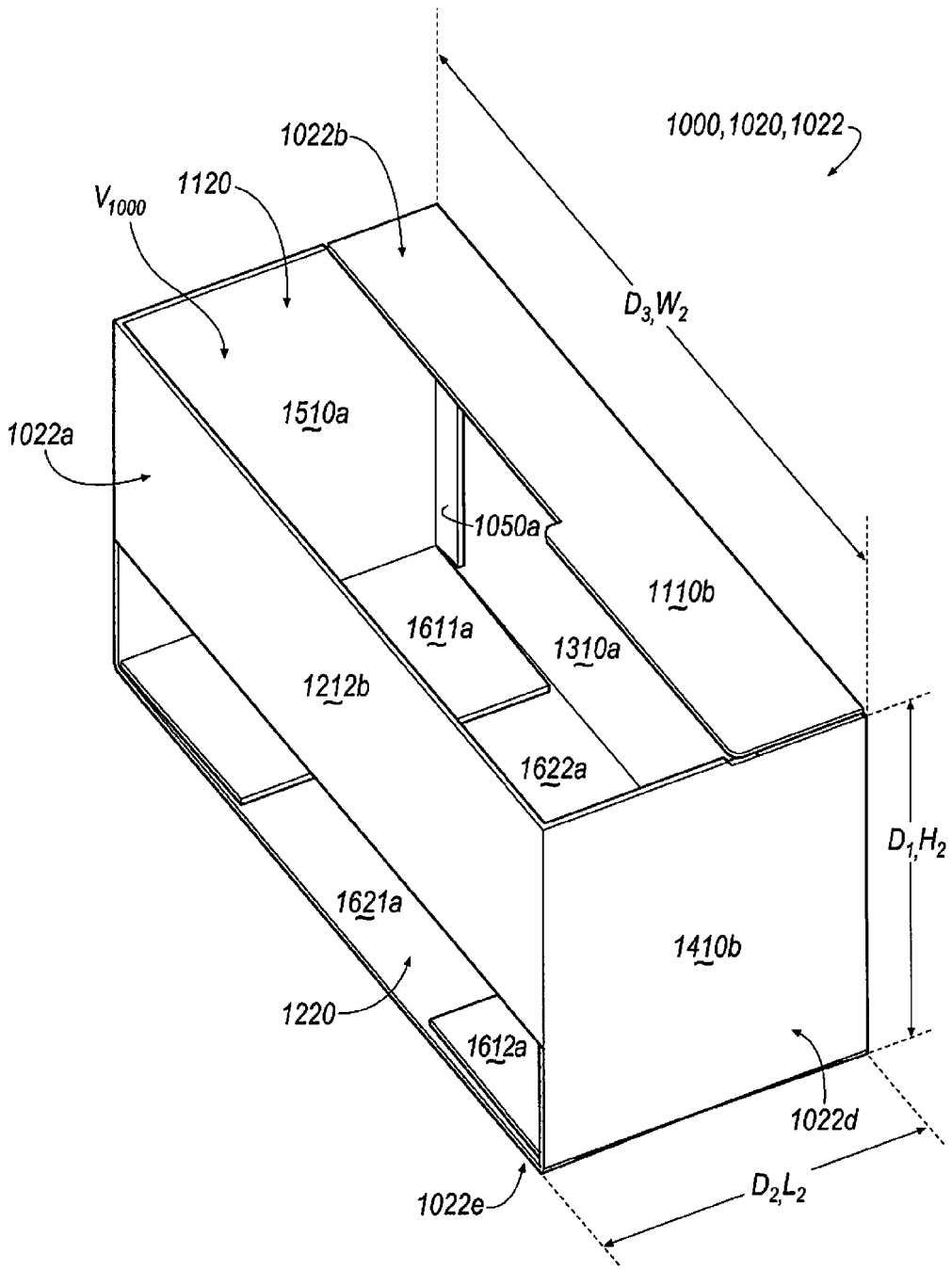
FIG. 7A
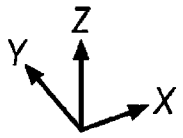

DUAL MERCHANDIZING CASE

CROSS REFERENCE TO RELATED APPLICATION

This application claims the benefit of U.S. Provisional application no. 62/163,537, filed on May 19, 2015. The entire contents of the aforementioned application are hereby incorporated by reference in their entirety.

TECHNICAL FIELD

The present disclosure relates to packaging for displaying and dispensing products.

BACKGROUND

Product packaging, such as merchandizing cases, may be utilized for shipping, storing, displaying, and dispensing products. Manufacturers often utilize regular slotted containers (RSCs) for the packaging of products, as RSCs can be made in a variety of shapes and sizes and are therefore useful for displaying products on shelves of varying shapes and sizes. RSCs generally have an upper wall, a bottom wall, and four side walls that connect the upper wall to the bottom wall. The upper wall and the bottom wall are typically formed by four flaps that close to form the upper wall and the bottom wall. This construction minimizes the necessary material for construction and, as a result, reduces the cost associated with producing the RSC.

The size and shape of merchandizing cases such as RSCs vary according to the particular characteristics of the product being shipped, stored, displayed, or dispensed and other environmental conditions. With both floor space and storage volume often at a premium, product retailers often require merchandizing cases that maximize product storage in limited floor space and storage volume. Additionally, the design of merchandizing cases must enhance display features to attract consumers and allow for desirable dispensing of the product. Finally, merchandizing cases are typically application-specific; having a shape, size, and/or predetermined dispensing opening designed for a specific retailer and/or display shelf.

SUMMARY

In one configuration, a merchandizing case is provided and may include a housing having a first wall, a second wall, a third wall, a fourth wall, a fifth wall, and a sixth wall. The first wall may oppose and may be substantially parallel to the sixth wall, the third wall may oppose and may be substantially parallel to the second wall, and the fifth wall may oppose and may be substantially parallel to the fourth wall. The housing may have an interior volume defined by the first wall, the second wall, the third wall, the fourth wall, the fifth wall, and the sixth wall. A first dispensing opening may be formed in the first wall to provide access to the interior volume, whereby the first dispensing opening is usable when the housing is supported by the third wall. A second dispensing opening may be formed in the second wall to provide access to the interior volume, whereby the second dispensing opening is usable when the housing is supported by the sixth wall.

A merchandizing case is provided and may include a housing having a first wall, a second wall, a third wall, a fourth wall, a fifth wall, and a sixth wall. The first wall may oppose and may be substantially parallel to the sixth wall, the third wall may oppose and may be substantially parallel to the second wall, and the fifth wall may oppose and may be substantially parallel to the fourth wall. The housing may have an interior volume defined by the first wall, the second wall, the third wall, the fourth wall, the fifth wall, and the sixth wall. A first dispensing opening may be formed in the first wall to provide access to the interior volume and a second dispensing opening may be formed in the second wall to provide access to the interior volume. An access panel may be movable from a first state restricting access to the interior volume via one of the first dispensing opening and the second dispensing opening and a second state permitting access to the interior volume via the one of the first dispensing opening and the second dispensing opening. The access panel may include a first panel having a first cutout and a second panel having a second cutout, whereby the first cutout cooperates with the second cutout to provide an access hole that facilitates removal of the first panel and the second panel from the housing to move the access panel from the first state to the second state.

The details of one or more implementations of the disclosure are set forth in the accompanying drawings and the description below. Other aspects, features, and advantages will be apparent from the description and drawings, and from the claims.

DESCRIPTION OF DRAWINGS

FIGS. 7A-7C are perspective views of the merchandizing case of FIG. 2A in an erected state and in a second utilization position;

Like reference symbols in the various drawings indicate like elements.

DETAILED DESCRIPTION

Figure 1A:
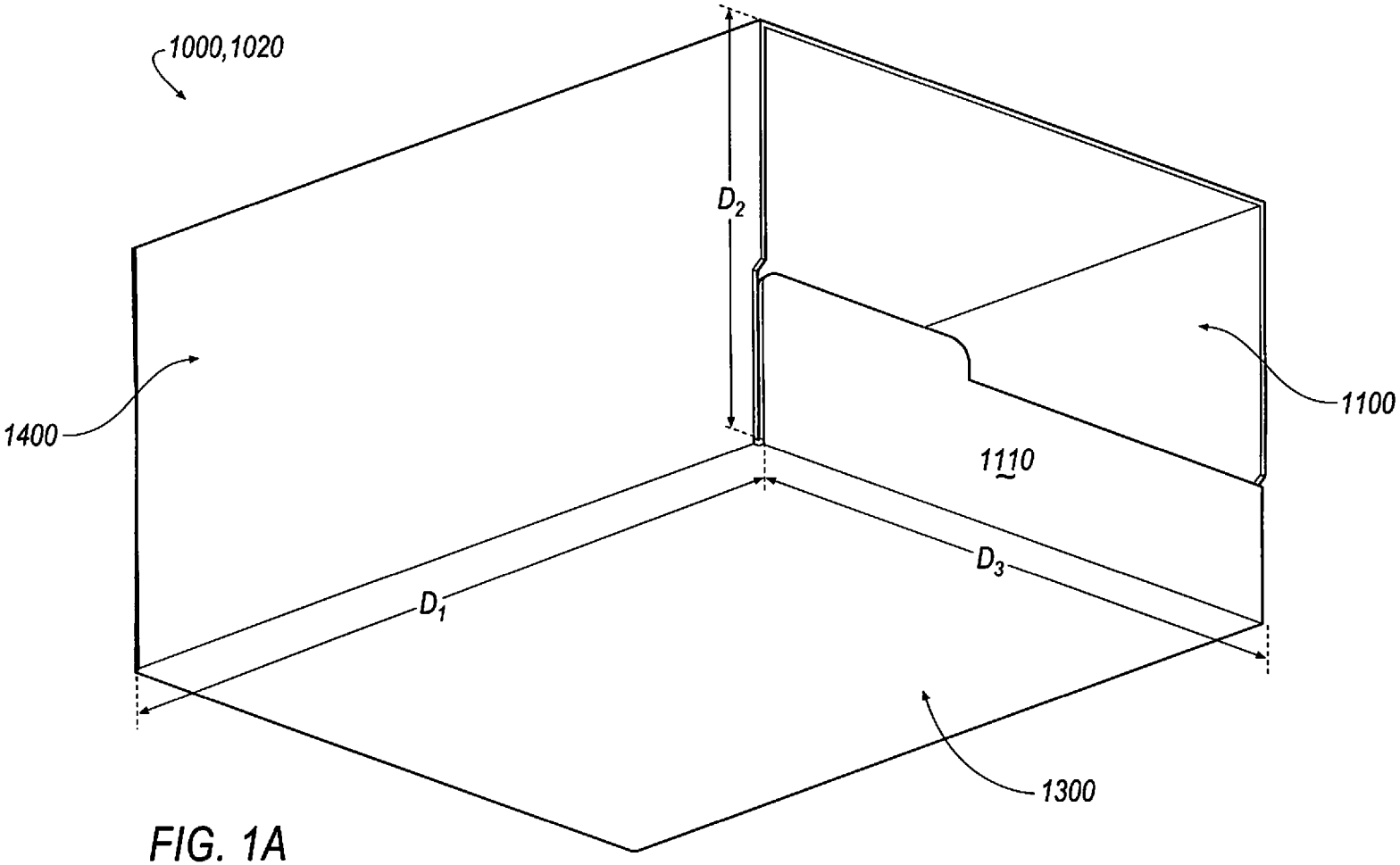
FIGS. 1A-1B are perspective views of an example dual merchandizing case in an erected state.
Figure 1B:
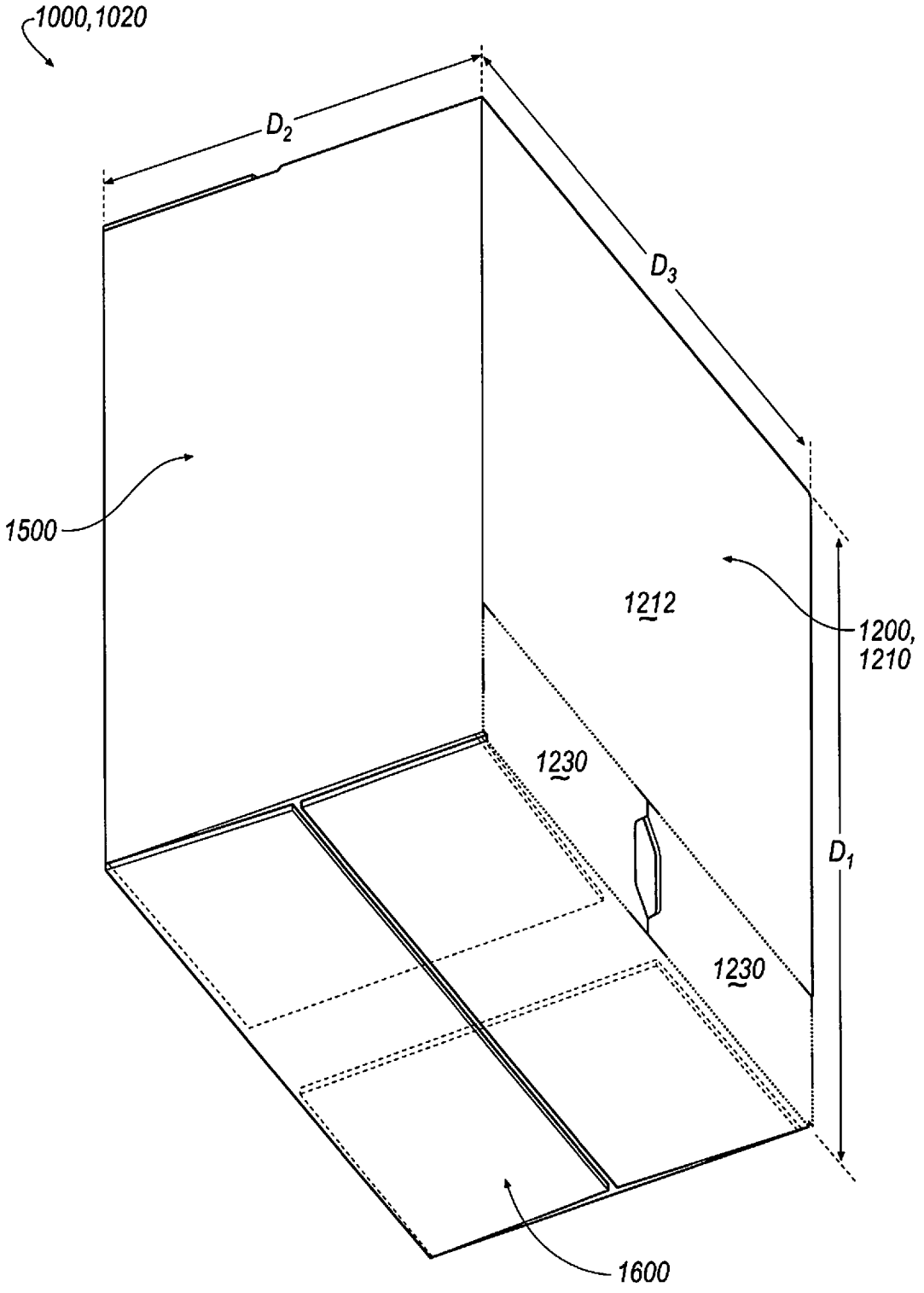

Referring to FIGS. 1A-1B, the dual merchandizing case 1000 of the present disclosure is shown in its erected state 1020 and as a standard regular slotted container (RSC) modified for dual utility. The merchandizing case 1000 has a first dimension $D_1$, a second dimension $D_2$, and a third dimension $D_3$. In the particular configuration of the erected state 1020 of the merchandizing case 1000 illustrated in FIGS. 1A-1B, the first dimension $D_1$ is greater than the second dimension $D_2$ and the third dimension $D_3$. The merchandizing case 1000 includes a housing formed by a first face or wall 1100, a second face or wall 1200, a third face or wall 1300, a fourth face or wall 1400, a fifth face or wall 1500, and a sixth face or wall 1600.

Referring specifically to FIG. 1A, the first face 1100 of the merchandizing case 1000 acts as a first presentation face that is substantially open except for a presentation lip 1110, which defines a first dispensing opening or display opening 1120 at the first face 1100. When the first face 1100 forms the front of the merchandizing case 1000, the presentation lip 1110 provides the merchandizing case 1000 with an appearance similar to that of a display tray. Further, the first face 1100 provides a surface for a first display (i.e., on the presentation lip 1110) that provides an indication as to the contents of the merchandizing case 1000 (i.e., text, graphics, etc.). As will be described, the presentation lip 1110 restricts product from inadvertently falling out of the merchandising case 1000 while simultaneously allowing the product to be viewed (i.e., in an open area above the lip 1110).

Referring specifically to FIG. 1B, the second face 1200 includes a panel 1210 that acts as a second presentation face 1200 of the merchandizing case 1000 and includes a pair of tear-away or access panels 1230 and a display wall 1212. The second face 1200 is disposed adjacent to the first face 1100 of the merchandizing case 1000. When the tear-away panels 1230 are removed, the second face 1200 may form the front of the merchandizing case 1000 and may provide the merchandizing case 1000 with a gravity-feed option that includes a large billboard for artwork at the display wall 1212. Namely, the second face 1200 provides a surface for a second display (i.e., on the display wall 1212) that provides an indication as to the contents of the merchandizing case 1000 (i.e., text, graphics, etc.). In this configuration, the merchandising case 1000 may rest on the sixth face 1600 such that product disposed within the case 1000 is gravity fed to the area of the display wall 1212 at a location of the tear-away panels 1230. When the tear-away panels 1230 are removed from the display wall 1212, product disposed within the case 1000 may be removed from the case 1000 at the location of the tear-away panels.

The first dimension $D_1$ of the merchandizing case 1000, the second dimension $D_2$ of the merchandizing case 1000, the third dimension $D_3$ of the merchandizing case 1000, and the proportionality of these dimensions may vary without deviating from the design of this disclosure. Additionally, the quantity of faces that form the merchandizing case 1000 may also vary without deviating from the design of the disclosure. Further, while the tear-away panels 1230 are described and shown as being disposed along a width of the display wall 1212 at a junction of the display wall 1212 and the sixth face 1600, the tear-away panels 1230 could alternatively be located along a length of the display wall 1212. The merchandizing case 1000 will be described hereinafter with the tear-away panels 1230 being disposed along a length of the display wall 1212 rather than being disposed along a width of the display wall 1212, as shown in FIGS. 1A and 1B. Further yet, while the display opening 1120 is shown in FIGS. 1A and 1B as being located along a width of the first face 1100, the display opening 1120 could alternatively extend along a length of the first face 1100. The merchandising case 1000 will be described herein after with the display opening 1120 being disposed along a length of the first face 1100.

Figure 2A:
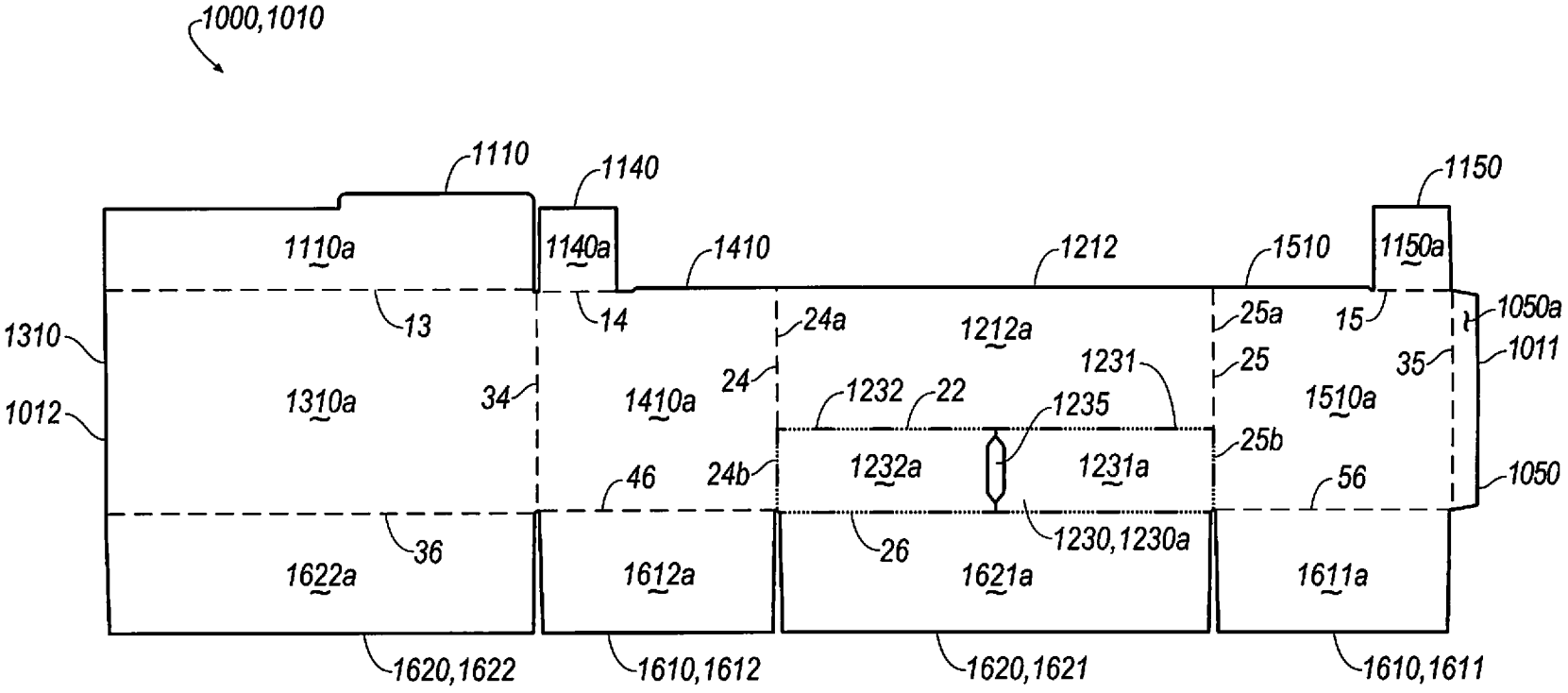
FIG. 2A is a plan view of a sheet of material used to form the dual merchandizing case of FIGS. 1A-1B and shown in a pre-erected state.
Figure 2B:
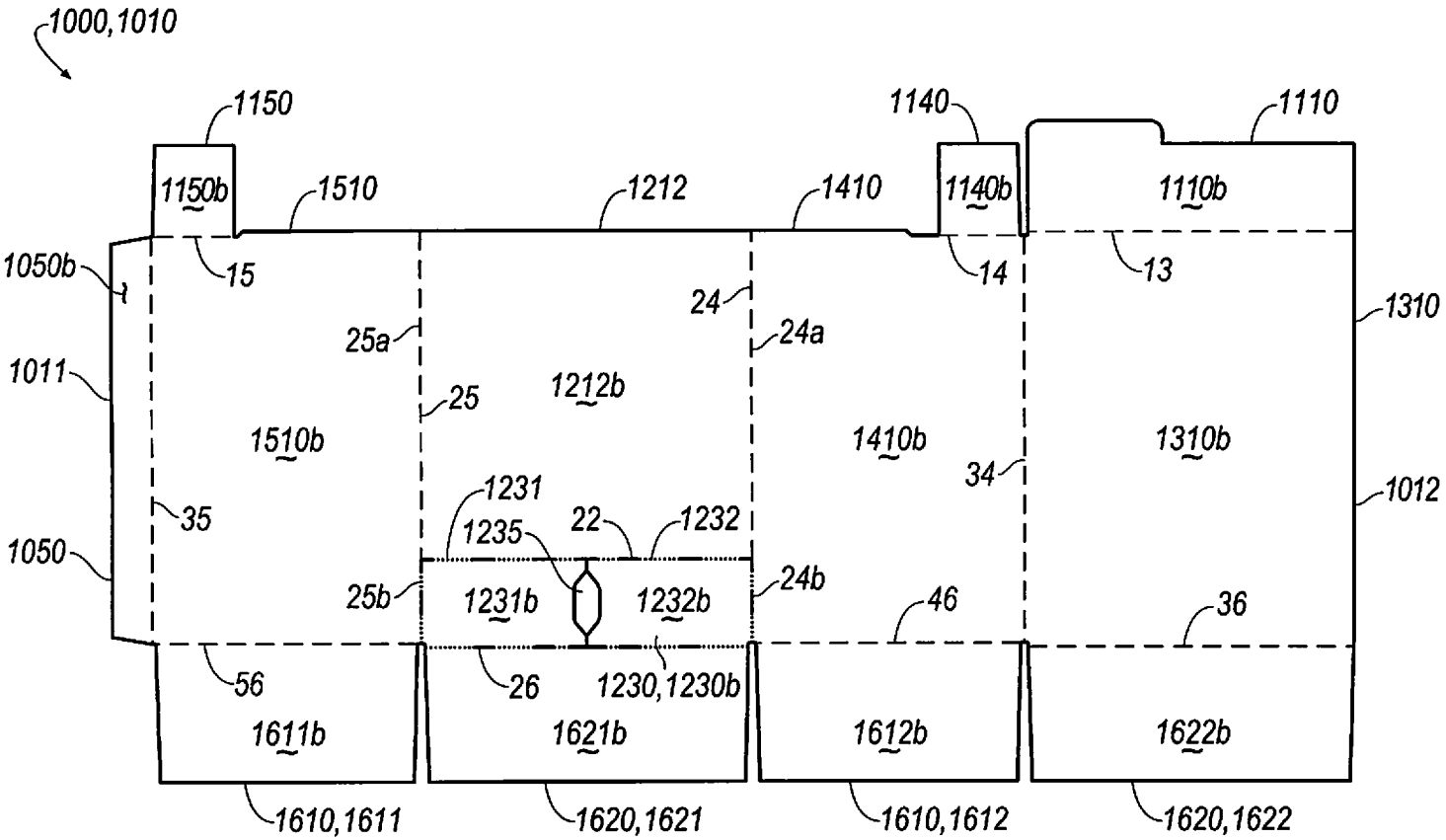
FIG. 2B is a plan view of the sheet of material of FIG. 2 showing a surface that forms an outer surface of the dual merchandizing case of FIGS. 1A-1B.
Figure 4A:
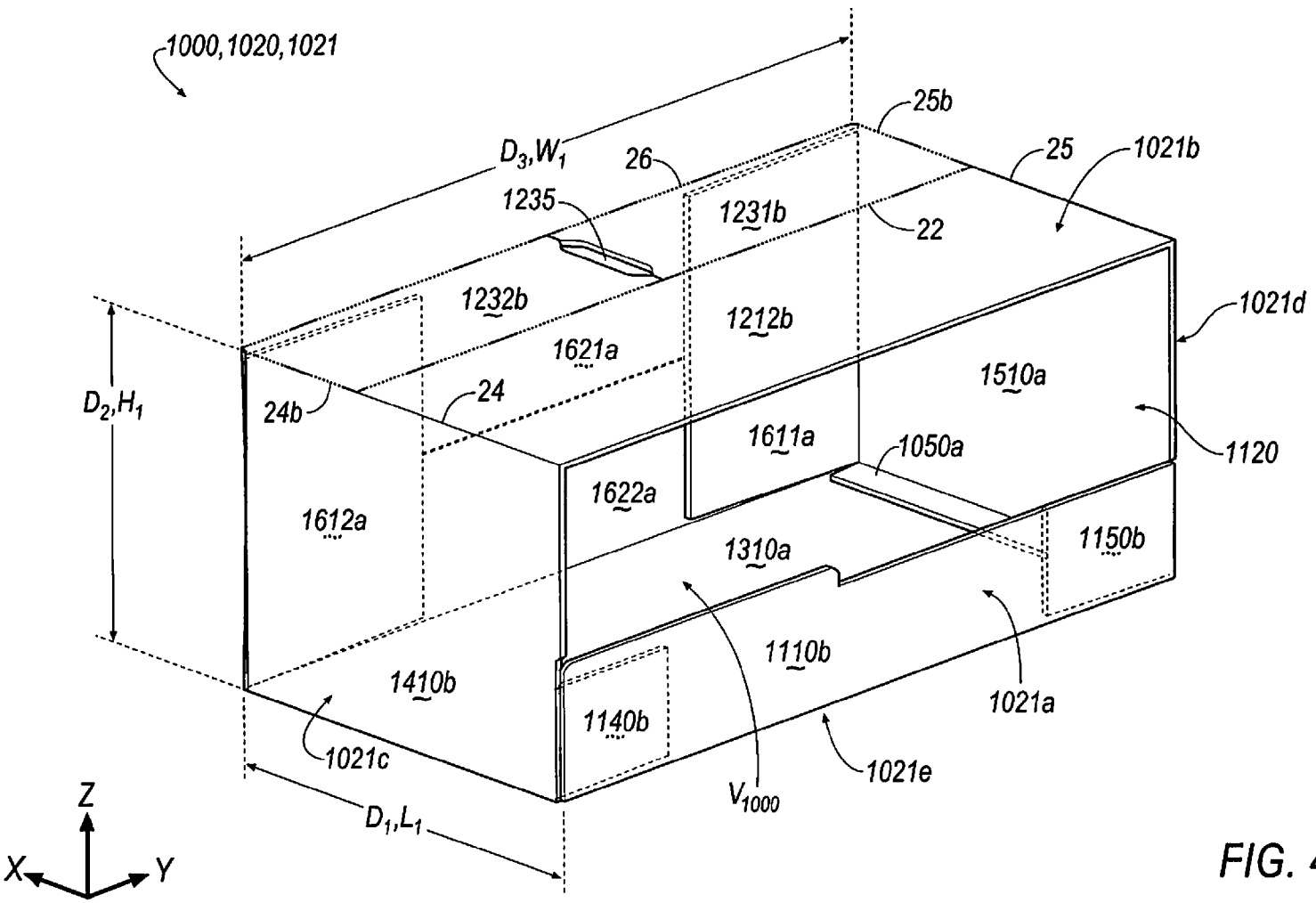
FIGS. 4A-4C are perspective views of the merchandizing case of FIG. 2A in an erected state and in a first utilization position.
Figure 4B:
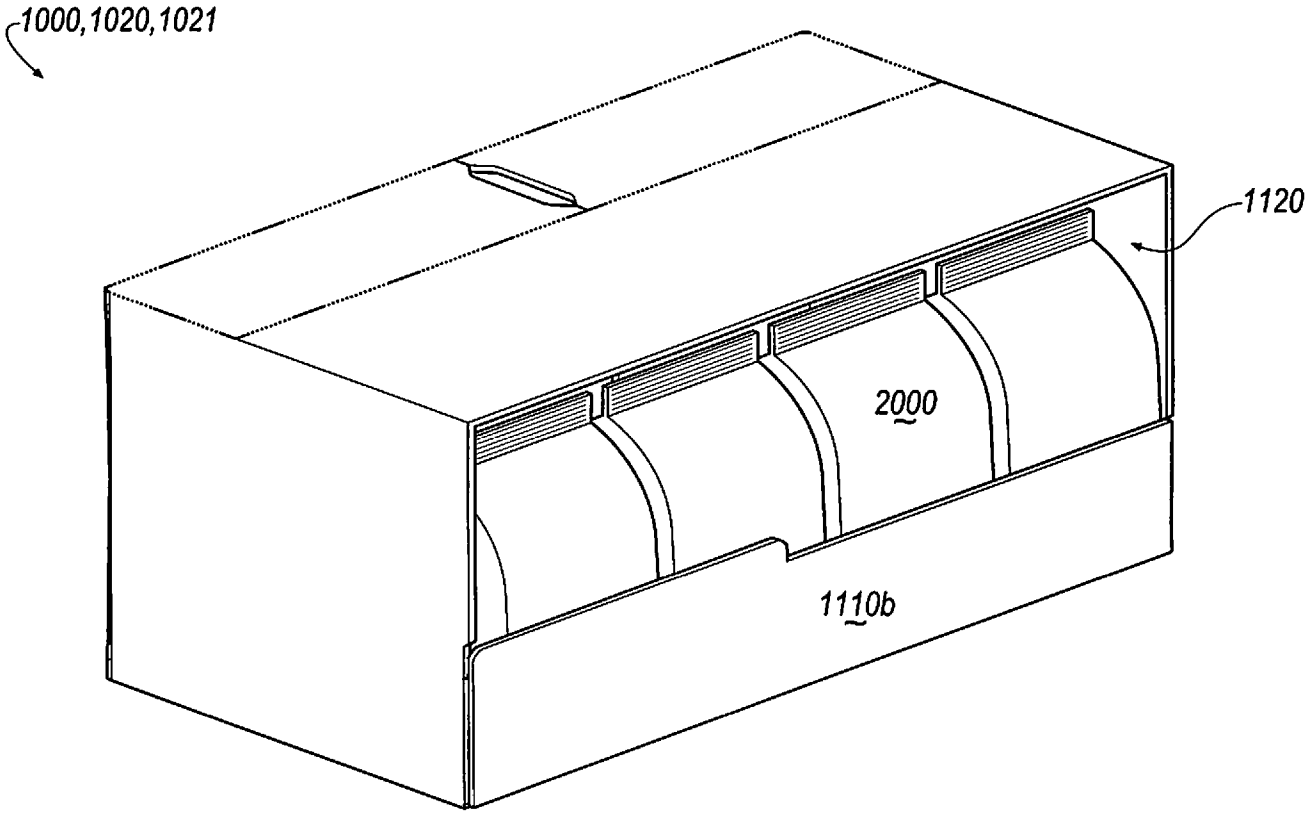
Figure 4C:
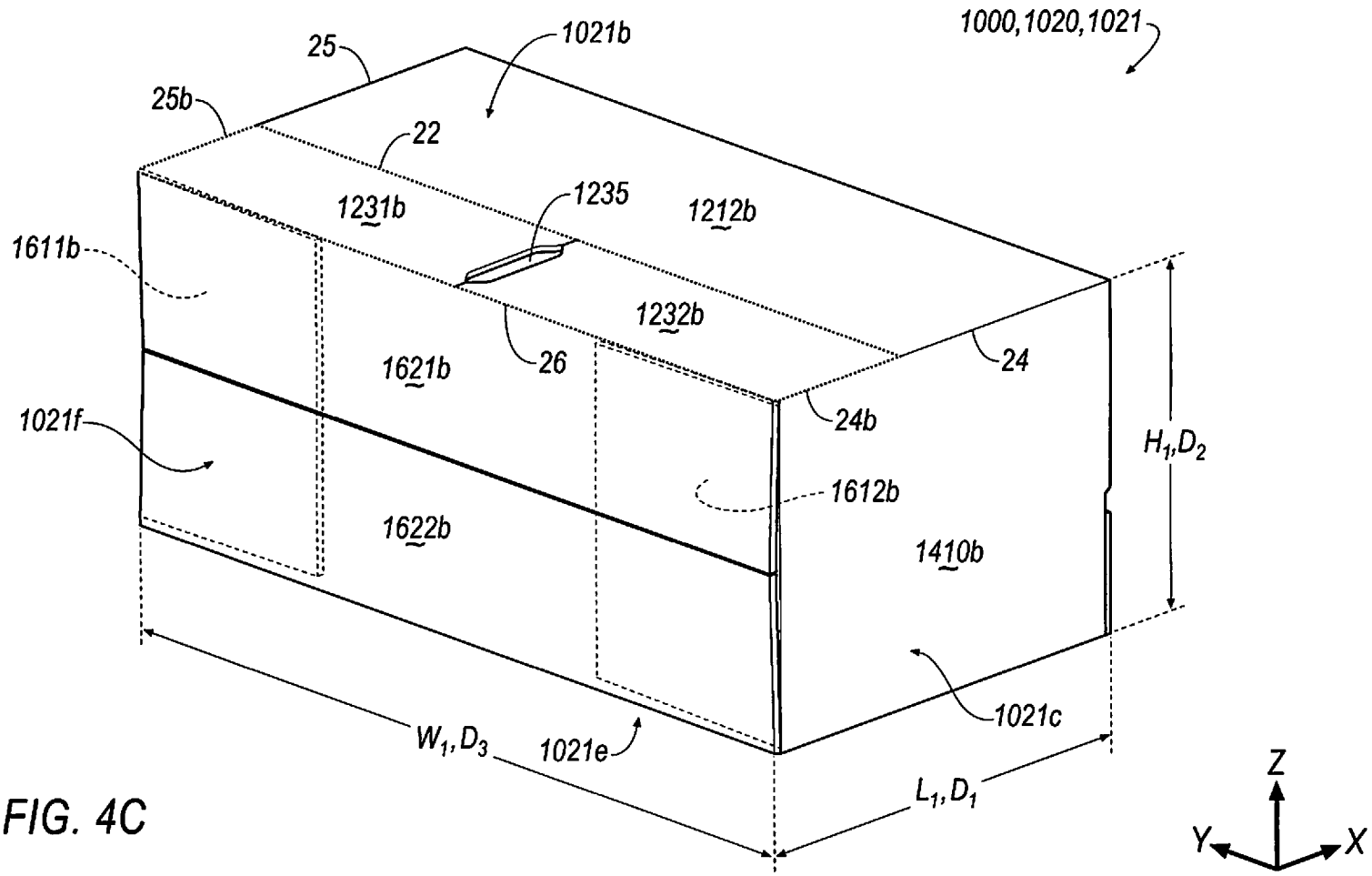

Referring to FIGS. 2A-2B, the merchandizing case 1000 is shown in a pre-erect state 1010. The merchandizing case 1000 is formed from an integral sheet of material. Once assembled into the erect state 1020, the sheet of material shown in FIGS. 2A and 2B takes the shape of the merchandizing case 1000 shown in FIGS. 4A-4C. As described above, the location of the tear-away portions 1230 and display opening 1120 shown in FIGS. 4A-4C differs from the location of the tear-away portions 1230 and display opening 1120 shown in FIGS. 1A and 1B. Accordingly, the erect merchandising case 1000 of FIGS. 4A-4C is of a different shape and configuration than the merchandizing case 1000 of FIGS. 1A and 1B. This difference illustrates that the merchandizing case 1000 may take various shapes—depending on preferences for the size and shape of both the display opening 1120 (shown in FIG. 4A) on the first presentation face 1100 and the size and shape of the display wall 1212 of the second presentation face 1200—without deviating from the design of this disclosure.

The pre-erected state 1010 of the merchandizing case 1000 of FIGS. 2A-2B extends from a first end 1011 to a second end 1012. When the merchandizing case 1000 takes its erected state 1020, the first end 1011 of the merchandizing case 1000 attaches to the second end 1012 of the merchandizing case 1000. Additionally, the sixth face 1600 of the merchandizing case 1000 of FIGS. 2A-2B is formed by two minor flaps 1610 and two major flaps 1620 when the merchandizing case 1000 takes its erected state 1020. These flaps 1610, 1620 may be attached to one another at various locations to form the sixth face 1600.

The exemplary implementations of the merchandizing case 1000 shown in FIGS. 2A-2B each include an end flap 1050 at the first end 1011 of the pre-erected state 1010 of the merchandizing case 1000. When the merchandizing case 1000 takes its erected state 1020, the end flap 1050 adheres to the panel 1310 of the third face 1300 of the merchandizing case 1000 to attach the first end 1011 of the merchandizing case 1000 to the second end 1012 of the merchandizing case 1000. However, the first end 1011 of the merchandizing case 1000 may attach to the second end 1012 of the merchandizing case 1000 in a different manner without deviating from the design of this disclosure. For example, the shape or size of the end flap 1050 may deviate from what is illustrated in FIGS. 2A-2B, the end flap 1050 may attach to the panel 1310 in a different fashion, or the merchandizing case 1000 may not include an end flap 1050 at its first end 1011. If the case 1000 does not include an end flap 1050, a similar end flap 1050 could be included at the second end 1012 of the pre-erected state 1010 of the merchandizing case 1000.

A panel 1510 of the fifth face 1500 connects to the end flap 1050 at a scoring line 35. A first lip-supporting flap 1150 connects to the panel 1510 at a scoring line 15. A first minor flap 1611 connects to the panel 1510 of the fifth face 1500 at a scoring line 56. The scoring line 15 is located at an edge of the panel 1510 that opposes an edge of the panel 1510 at which the scoring line 56 is located, as shown in FIG. 2A.

A display wall 1212 and a tear-away panel 1230 are formed from the panel 1210 of the second presentation face 1200. The display wall 1212 and the tear-away panel 1230 connect to the panel 1510 of the fifth face 1500 at a scoring line 25. Particularly, the panel 1510 of the fifth face 1500 connects to the display wall 1212 at a first segment 25*a* of the scoring line 25 and the panel 1510 of the fifth face 1500 connects to the tear-away panel 1230 at a second segment 25*b* of the scoring line 25. The second segment 25*b* of the scoring line 25 provides a predetermined area of weakness, which may be created utilizing perforations formed into the material of the merchandizing case 1000. In other examples, the predetermined area of weakness disposed along the second segment 25*b* of the scoring line 25 may be implemented as a cut line, an alternation between cut lines and perforations, or any other implementation allowing easy severance along the second segment 25*b* of the scoring line 25. If perforations create the predetermined area of weakness along the second segment 25*b* of the scoring line 25, the perforations may include of a series of punctures to allow easy separation along the path of the perforations. When the tear-away panel 1230 is removed from the case 1000, the tear-away panel 1230 detaches from the panel 1510 of the fifth face 1500 by severing the second segment 25*b* of the scoring line 25. However, when this severance of the second segment 25*b* of the scoring line 25 occurs, the first segment 25*a* of the scoring line 25 does not sever and the display wall 1212 remains connected to the panel 1510 of the fifth face 1500.

Figure 5:
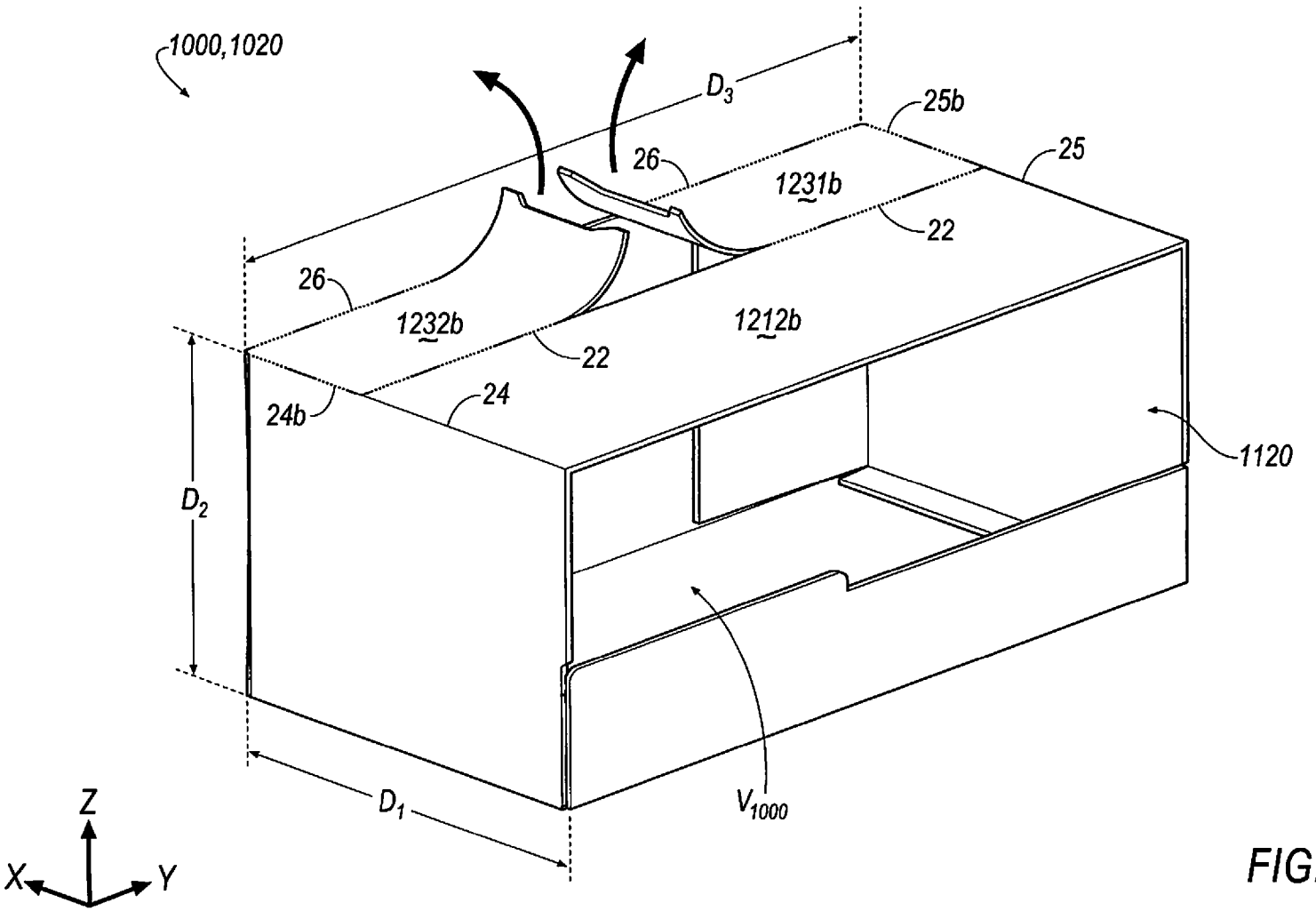
FIGS. 5-6 are perspective views of the merchandizing case of FIG. 2A in an erected state.
Figure 6:
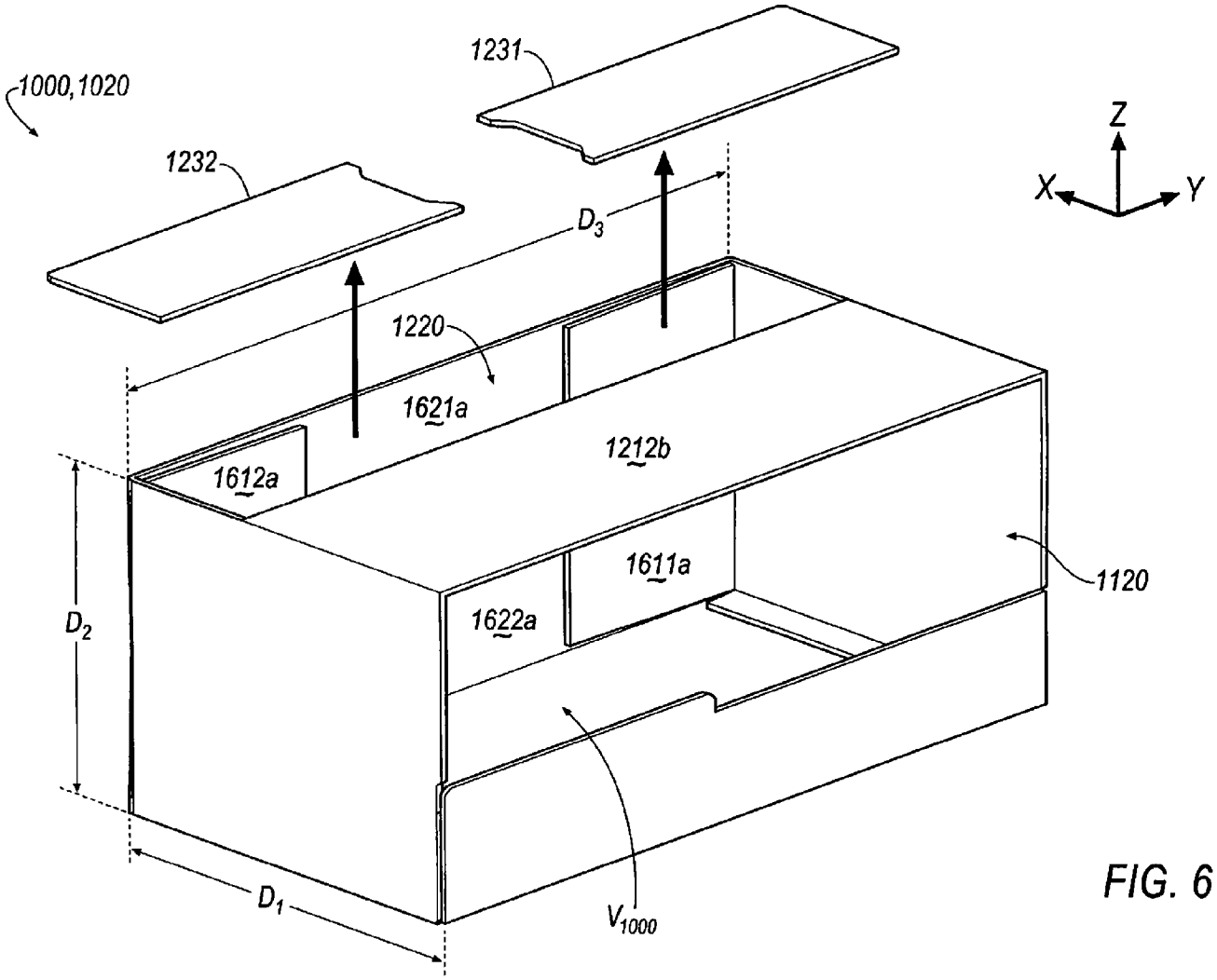

A first major flap 1621 connects to the tear-away panel 1230 at a scoring line 26 adjacent to the first minor flap 1611 that is connected to panel 1510 of the fifth face 1500. The scoring line 26 includes a predetermined area of weakness, which may be created utilizing perforations formed into the material of the merchandizing case 1000. In other examples, the predetermined area of weakness disposed along the scoring line 26 may be implemented as a cut line, an alternation between cut lines and perforations, or any other implementation allowing easy severance along the scoring line 26. If perforations create the predetermined area of weakness along the scoring line 26, the perforations may include of a series of punctures to allow easy separation along the path of the perforations. Normally, the tear-away panel 1230 is not removed from the case 1000 until after the merchandizing case 1000 is in its erected state 1020 (as shown in FIGS. 5-6), at which time the tear-away panel 1230 detaches from the first major flap 1621 by severing along the scoring line 26. Once the scoring line 26 is severed, the first major flap 1621 remains in place as a result of its connection to the two minor flaps 1610, which partially forms the sixth face 1600 of the merchandizing case 1000, as described in more detail below.

A tear-line 22, which extends across the panel 1210 of the second presentation face 1200, delineates the border between the display wall 1212 and the tear-away panel 1230. The tear-line 22 includes a predetermined area of weakness, which may be created utilizing perforations formed into the material of the panel 1210 of the second presentation face 1200 of the merchandizing case 1000. In other examples, the predetermined area of weakness forming the tear-line 22 may be implemented as a cut line, an alternation between cut lines and perforations, or any other implementation allowing easy severance along the path of the predetermined area of weakness of the tear-line 22. If perforations create the predetermined area of weakness of the tear-line 22, the perforations may include a series of punctures to allow easy separation along the path of the perforations.

The tear-away panel 1230 has a shape defined by the tear-line 22, the second segment 25*b* of the scoring line 25, the scoring line 26, and a second segment 24*b* of scoring line 24. The tear-away panel 1230 includes a first removable tab or first panel 1231, a second removable tab or panel 1232, and a pull hole or access hole 1235 that divides the tear-away panel 1230 into the first removable tab 1231 and the second removable tab 1232. The pull hole 1235 may be formed such that the pull hole 1235 extends partially into each panel 1230, 1231 or, alternatively, into only one of the panels 1230, 1231. The tear-away panel 1230 may be implemented in a different fashion without deviating from the design of this disclosure. For example, the tear-away panel 1230 may only include a single tab with a pull hole 1235 disposed adjacent to either the second segment 25*b* of the scoring line 25 or the second segment 24*b* of the scoring line 24. Alternatively, the tear-away panel 1230 may not include a pull hole 1235, in which case the tear-away panel 1230 may be to torn away utilizing a pull tab, for example. Finally, the merchandizing case 1000 may not include a tear-away panel 1230, in which case an opening may be formed into the second presentation face 1200 of the merchandizing case 1000 at the location in FIGS. 2A-2B where the tear-away panel 1230 is shown.

A panel 1410 of the fourth face 1400 connects to the display wall 1212 and the tear-away panel 1230 at a scoring line 24. Particularly, the panel 1410 of the fourth face 1400 connects to the display wall 1212 at a first segment 24*a* of the scoring line 24 and the panel 1410 of the fourth face 1400 connects to the tear-away panel 1230 at a second segment 24*b* of the scoring line 24. A second lip-supporting flap 1140 connects to the panel 1410 of the fourth face 1400 at a scoring line 14. A second minor flap 1612 connects to the panel 1410 of the fourth face 1400 at a scoring line 46 adjacent to the first major flap 1621. The scoring line 14 is located at an edge of the panel 1410 that opposes an edge of the panel 1410 at which the scoring line 46 is located.

The second segment 24*b* of the scoring line includes a predetermined area of weakness, which may be created utilizing perforations formed into the material of the merchandizing case 1000. In other examples, the predetermined area of weakness extending along the second segment 24*b* of the scoring line 24 may be implemented as a cut line, an alternation between cut lines and perforations, or any other implementation allowing easy severance along the second segment 24*b* of the scoring line 24. If perforations create the predetermined area of weakness along the second segment 24*b* of the scoring line 24, the perforations may include of a series of punctures to allow easy separation along the path of the perforations. When the tear-away panel 1230 is torn away, the tear-away panel 1230 detaches from the panel 1410 of the fourth face 1400 by severing the second segment 24*b* of the scoring line 24. However, when severance of the second segment 24*b* of the scoring line 24 occurs, the first segment 24*a* of the scoring line 24 does not sever and the display wall 1212 remains connected to the panel 1410 of the fourth face 1400.

A panel 1310 of the third face 1300 connects to the panel 1410 at a scoring line 34. The edge of the panel 1310 of the third face 1300 opposing the scoring line 34 forms the second end 1012 of the pre-erected state 1010 of the merchandizing case 1000. A presentation lip 1110 connects to the panel 1310 at a scoring line 13. A second major flap 1622 connects to the panel 1310 of the third face 1300 at a scoring line 36 located adjacent to the second minor flap 1612 that connects to the panel 1410 of the fourth face 1400. The scoring line 13 is located at an edge of the panel 1310 that opposes an edge of the panel 1310 at which the scoring line 36 is located.

FIG. 2A illustrates the surface forming an inner surface of the merchandising case 1000 when the case 1000 is in the erected state 1020. FIG. 2B illustrates the outer surface of the merchandizing case 1000 when the case 1000 is in the erected state 1020. Accordingly, in FIG. 2A, the inner surface 1050*a* of the end flap 1050, the inner surface 1510*a* of the panel 1510 of the fifth face 1500, the inner surface 1212*a* of the display wall 1212, the inner surface 1230*a* of the tear-away panel 1230 (and the inner surface 1231*a*,

1232*a* of the two removable tabs 1231, 1232 formed from the tear-away panel 1230), the inner surface 1410*a* of the panel 1410 of the fourth face 1400, the inner surface 1310*a* of the panel 1310 of the third face 1300, the inner surfaces 1611*a*, 1612*a*, 1621*a*, 1622*a* of the minor flaps 1610 and the major flaps 1620, the inner surfaces 1140*a*, 1150*a* of the lip-supporting flaps 1140, 1150, and the inner surface 1110*a* of the presentation lip 1110 are shown. Conversely, in FIG. 2B, the outer surface 1050*b* of the end flap 1050, the outer surface 1510*b* of the panel 1510 of the fifth face 1500, the outer surface 1212*b* of the display wall 1212, the outer surface 1230*b* of the tear-away panel 1230 (and the outer surfaces 1231*b*, 1232*b* of the two removable tabs 1231, 1232 formed from the tear-away panel 1230), the outer surface 1410*b* of the panel 1410 of the fourth face 1400, the outer surface 1310*b* of the panel 1310 of the third face 1300, the outer surfaces 1611*b*, 1612*b*, 1621*b*, 1622*b* of the minor flaps 1610 and the major flaps 1620, the outer surfaces 1140*b*, 1150*b* of the lip-supporting flaps 1140, 1150, and the outer surface 1110*b* of the presentation lip 1110 are shown.

Any of the faces of the merchandizing case 1000 may include additional features that are not illustrated in FIGS. 2A-2B without deviating from the design of this disclosure. Such additional features may include hand-holes, sensory holes, handling tabs, or any other desired feature. Although the merchandizing case 1000 of this disclosure may include such features, such features are not required according to the design of this disclosure and are not illustrated in the figures.

Figure 3:
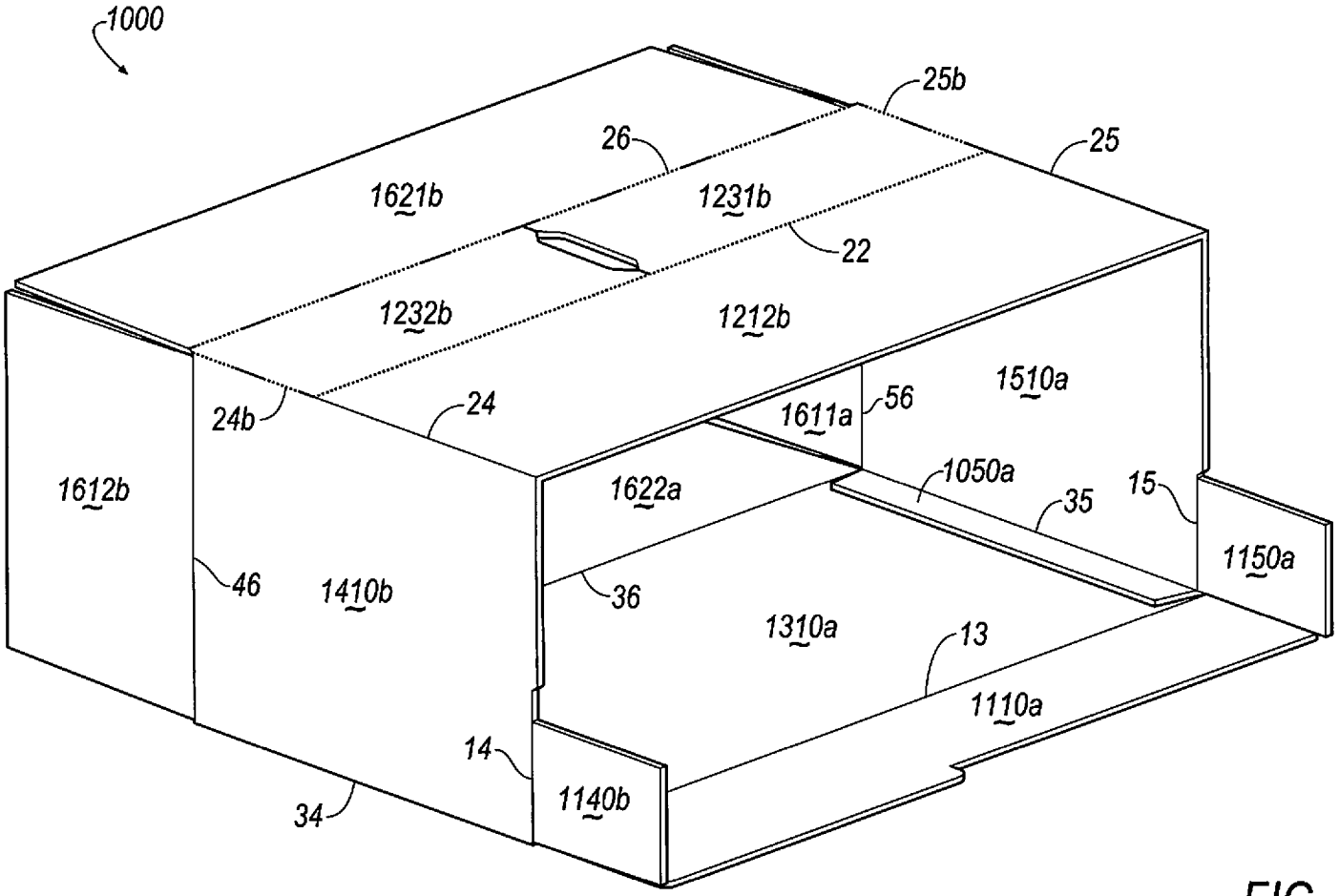
FIG. 3 is a perspective view of the merchandizing case of FIG. 2A in a partially erected state.

The merchandizing case is capable of being erected from the pre-erected state 1010 (as shown in FIGS. 2A-2B) of an integral sheet of material into the erected state 1020 (as shown in FIGS. 4A-4C). Referring to FIG. 3, to begin erection of the merchandizing case 1000, the merchandizing case 1000 is creased along scoring lines 24, 25, 34, and 35. The first end 1011 of the merchandizing case 1000 is attached to the second end 1012 of the merchandizing case 1000 when the outer surface 1050*b* of the end flap 1050 is adhered to the inner surface 1310*a* of the panel 1310 of the third face 1300. At this point, and as shown in FIG. 3, the panel 1310 of the third face 1300 opposes the display wall 1212 and the removable tabs 1231, 1232 of the second presentation face 1200 and the panel 1410 of the fourth face 1400 opposes the panel 1510 of the fifth face 1500.

Next, the scoring lines 13, 14, 15 are creased. The outer surface 1150*b* of the first lip-supporting flap 1150 and the outer surface 1140*b* of the second lip-supporting flap 1140 are each adhered to the inner surface 1110*a* of the presentation lip 1110. In this fashion, the first presentation face 1100 is formed as a substantially open face with a display tray appearance formed by the presentation lip 1110 and the display opening 1120 (as illustrated in FIGS. 4A-4B).

Finally, the scoring lines 26, 36, 46, 56 are creased. The outer surface 1611*b* of the first minor flap 1611 and the outer surface 1612*b* of the second minor flap 1612 are each adhered to the inner surface 1621*a*, 1622*a* of each the first major flap 1621 and the second major flap 1622. In this fashion, the two minor flaps 1610 and the two major flaps 1620 substantially enclose the sixth face 1600 of the merchandizing case 1000 (as illustrated in FIG. 4C). The predetermined areas of weakness disposed along the tear-line 22, along the scoring line 26, along the second segment 24*b* of the scoring line 24, and along the second segment 25*b* of the scoring line 25 need not be severed during the erection of the merchandizing case 1000.

Following its erection, the merchandizing case 1000 takes its erected state 1020, as illustrated in FIGS. 4A-7C. In its erected state 1020, the merchandizing case 1000 encloses an interior volume $V_{1000}$ and has a first dimension $D_1$, a second dimension $D_2$, and a third dimension $D_3$. The first presentation face 1100 and the sixth face 1600 both reside in a plane of the second dimension $D_2$ and the third dimension $D_3$, and these faces oppose each other at a distance defined in the first dimension $D_1$. The second presentation face 1200 and the third face 1300, which are both adjacent to the first presentation face 1100, both reside in a plane of the first dimension $D_1$ and the third dimension $D_3$, and these faces oppose each other at a distance defined in the second dimension $D_2$. The fourth face 1400 and the fifth face 1500, which are both adjacent to the first presentation face 1100, both reside in a plane of the first dimension $D_1$ and the second dimension $D_2$, and these faces oppose each other at a distance defined in the third dimension $D_3$.

Referring specifically to FIGS. 4A-4C, when the merchandizing case 1000, in its erected state 1020, is utilized in its first position 1021, the front 1021*a* of the merchandizing case 1000 is formed by the presentation lip 1110 (held in place by the first lip-supporting flap 1150 and the second lip-supporting flap 1140) and the display opening 1120 of the first presentation face 1100. Additionally, the display wall 1212, the first removable tab 1231, and the second removable tab 1232 of second presentation face 1200 form the top 1021*b* of the merchandizing case 1000, the panel 1410 of the fourth face 1400 forms the left side 1021*c* of the merchandizing case 1000, the panel 1510 of the fifth face 1500 forms the right side 1021*d* of the merchandizing case 1000, the panel 1310 of the third face 1300 forms the bottom 1021*e* of the merchandizing case 1000, and the flaps 1611, 1612, 1621, 1622 of the sixth face 1600 form the rear 1021*f* of the merchandizing case 1000. The first dimension $D_1$ of the merchandizing case 1000 is arranged along a longitudinal x-axis to form the length $L_1$ of the merchandizing case 1000 in its first position 1021. The second dimension $D_2$ of the merchandizing case 1000 is arranged along a vertical z-axis to form the height $H_1$ of the merchandizing case 1000 in its first position 1021. The third dimension $D_3$ of the merchandizing case 1000 is arranged along a transverse y-axis to form the width $W_1$ of the merchandizing case 1000 in its first position 1021.

Referring specifically to FIG. 4B, a quantity of a product 2000 may reside within the interior volume $V_{1000}$ of the merchandizing case 1000. When the erected state 1020 of the merchandizing case 1000 is utilized in its first position 1021, the product 2000 disposed within the interior volume $V_{1000}$ of the merchandizing case 1000 is displayed through the display opening 1120 and is held within the interior volume $V_{1000}$ of the merchandizing case 1000 by the presentation lip 1110. The product 2000 is not gravity fed from the interior volume $V_{1000}$ of the merchandizing case 1000 when the merchandizing case is utilized in its first position 1021. Rather, the product rests on the inner surface 1310*a* of the panel 1310.

Figure 7B:
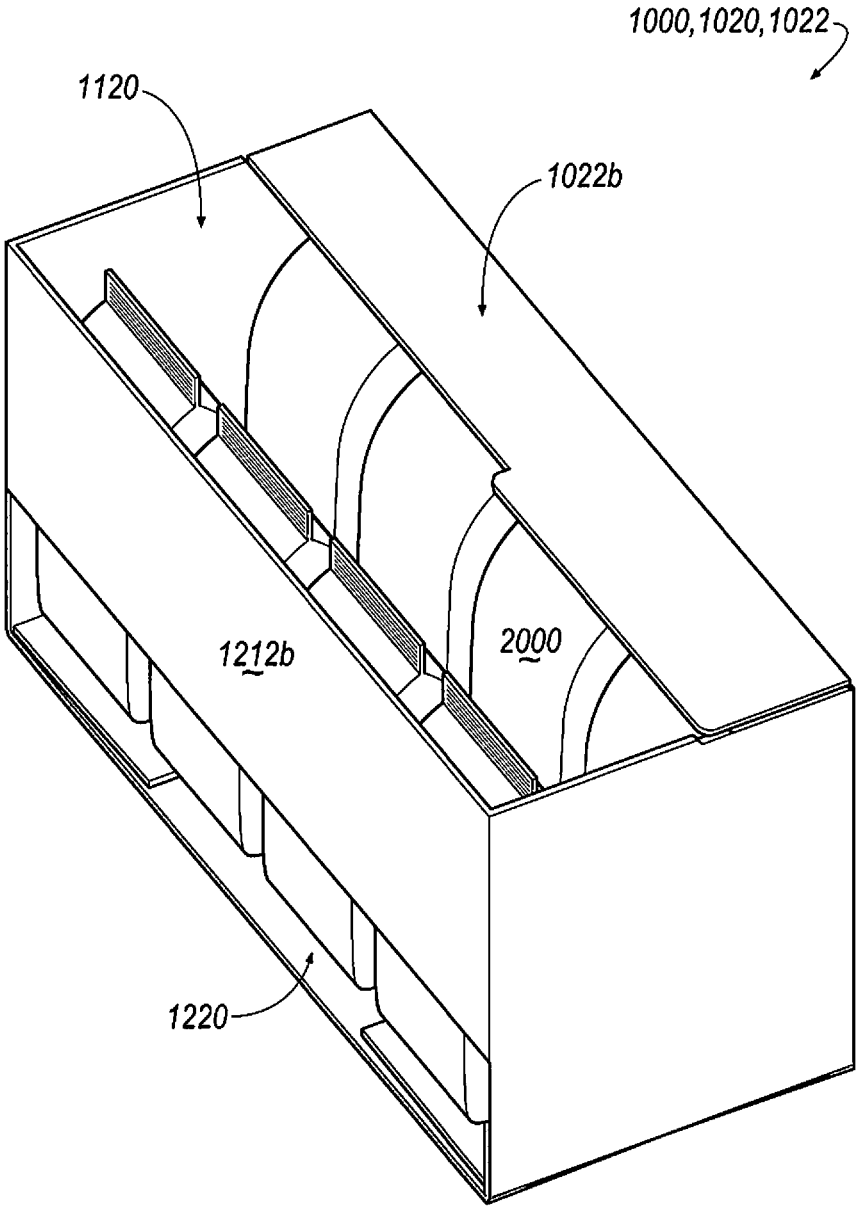
Figure 7C:
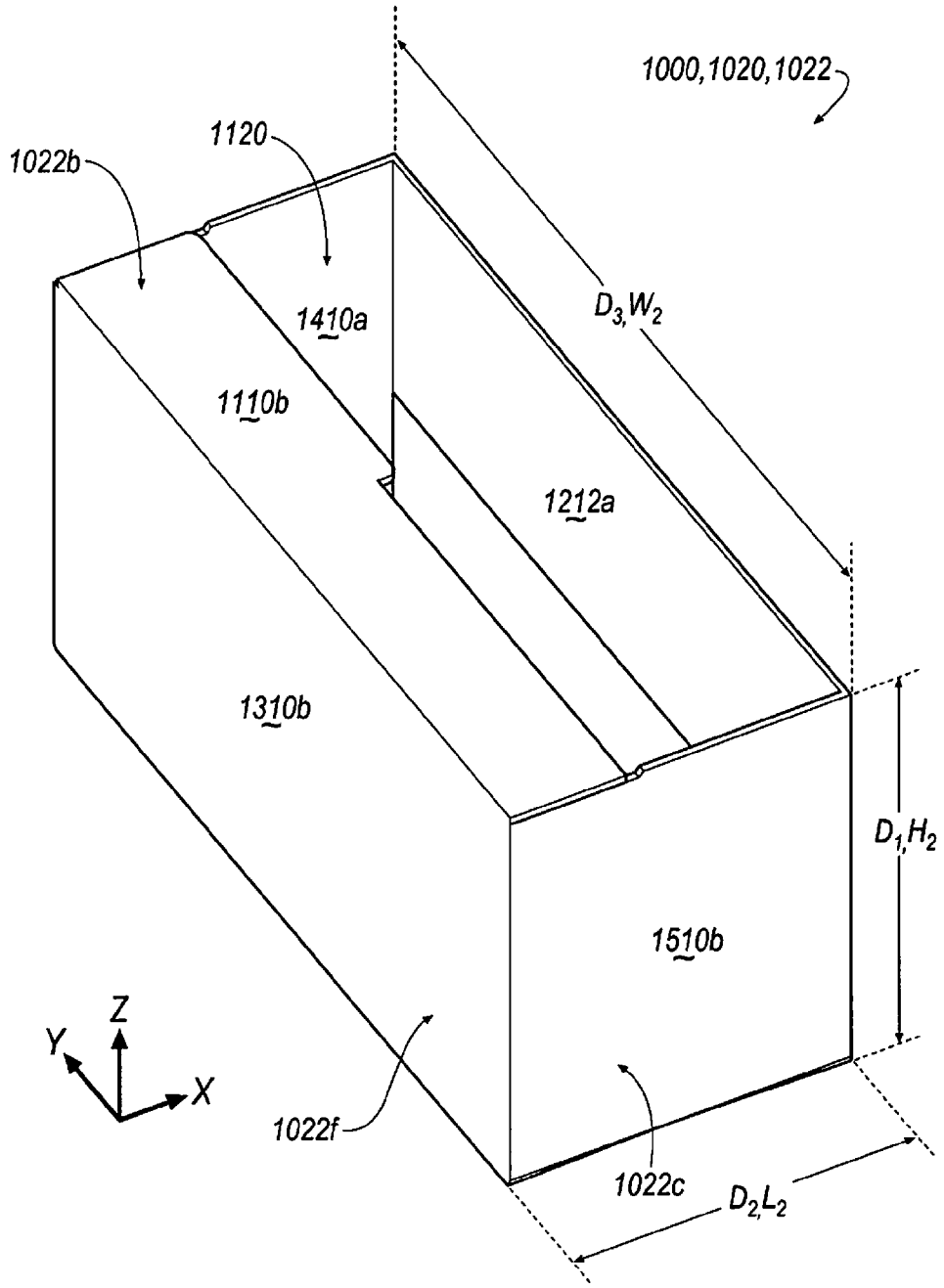

Referring specifically to FIGS. 5-6, before the erected state 1020 of the merchandizing case 1000 can be utilized in its second position 1022 (as shown in FIGS. 7A-7C), at least one of the first removable tab 1231 and the second removable tab 1232 of the tear-away panel 1230 must be detached from the merchandizing case 1000. Referring specifically to FIG. 5, the pull hole 1235 of the tear-away panel 1230 provides a user with access to each tab 1231, 1232 to allow the user to grasp the tabs 1231, 1232 and apply a force on each tab 1231, 1232 in a vertical z-direction and a transverse y-direction to begin detaching the first removable tab 1231 and the second removable tab 1232 of the tear-away panel 1230 from the merchandizing case 1000. Detachment of the tabs 1231, 1232 from the merchandising case 1000 is accomplished by severing the predetermined areas of weakness along the tear-line 22 and the scoring line 26. Once the tear-line 22 and the scoring line 26 have been fully severed, the second segment 25*b* of the scoring line 25 is severed to fully detach the first removable tab 1231 and the second segment 24*b* of the scoring line 24 is severed to fully detach the second removable tab 1232. Referring specifically to FIG. 6, detachment of the first removable tab 1231 and the second removable tab 1232 creates a second dispensing opening 1220 in the second presentation face 1200 of the merchandising case 1000. The opening 1220 is disposed adjacent to the sixth face 1600 of the merchandizing case 1000 formed by the first minor flap 1611, the second minor flap 1612, the first major flap 1621, and the second major flap 1622. The display wall 1212 remains located over a portion of the second presentation face 1200. The merchandizing case 1000 now includes two openings 1120, 1220.

Referring specifically to FIGS. 7A-7C, the erected state 1020 of the merchandizing case 1000, after removal of the tear-away panel 1230, pivots from a first position 1021 (shown in FIGS. 4A-4C) to a second position 1022 (shown in FIGS. 7A-7C) by rotating about a line in the transverse y-direction. When the merchandizing case 1000 resides at its second position 1022, the opening 1220 serves as a gravity-fed opening 1220 at the bottom of the second presentation face 1200 without a retaining lip such as the presentation lip 1110 of the first presentation face 1100.

When the merchandizing case 1000, in its erected state 1020, is utilized in its second position 1022, the front 1022*a* of the merchandizing case 1000 is formed by the display wall 1212 and gravity-fed opening 1220 of the second presentation face 1200. Additionally, the presentation lip 1110 and the display opening 1120 of first presentation face 1100 form the top 1022*b* of the merchandizing case 1000, the panel 1510 of the fifth face 1500 forms the left side 1022*c* of the merchandizing case 1000, the panel 1410 of the fourth face 1400 forms the right side 1022*d* of the merchandizing case 1000, the flaps 1611, 1612, 1621, 1622 of the sixth face 1600 form the bottom 1022*e* of the merchandizing case 1000, and the panel 1310 of the third face 1300 forms the rear 1022*f* of the merchandizing case 1000. The first dimension $D_1$ of the merchandizing case 1000 is arranged along a vertical z-axis to form the height $H_2$ of the merchandizing case 1000 in its second position 1022. The second dimension $D_2$ of the merchandizing case 1000 is arranged along a longitudinal x-axis to form the length $L_2$ of the merchandizing case 1000 in its second position 1022. The third dimension $D_3$ of the merchandizing case 1000 remains arranged along a transverse y-axis to form the width $W_2$ of the merchandizing case 1000 in its second position 1022.

Referring specifically to FIG. 7B, a quantity of a product 2000 may reside within the interior volume $V_{1000}$ of the merchandizing case 1000. When the erected state 1020 of the merchandizing case 1000 is utilized in its second position 1022, the product 2000 disposed within the interior volume $V_{1000}$ of the merchandizing case 1000 is gravity fed from the interior volume $V_{1000}$ of the merchandizing case 1000 through the gravity-fed opening 1220. The display wall 1212 serves as a large billboard for art or product information residing above the gravity-fed opening 1220. Product may enter the interior volume $V_{1000}$ of the merchandizing case 1000 through the top 1022*b* of the merchandizing case 1000 by passing through the opening 1120 that serves as the display opening 1120 when the merchandizing case 1000 resides at its first position 1021.

Figure 8:
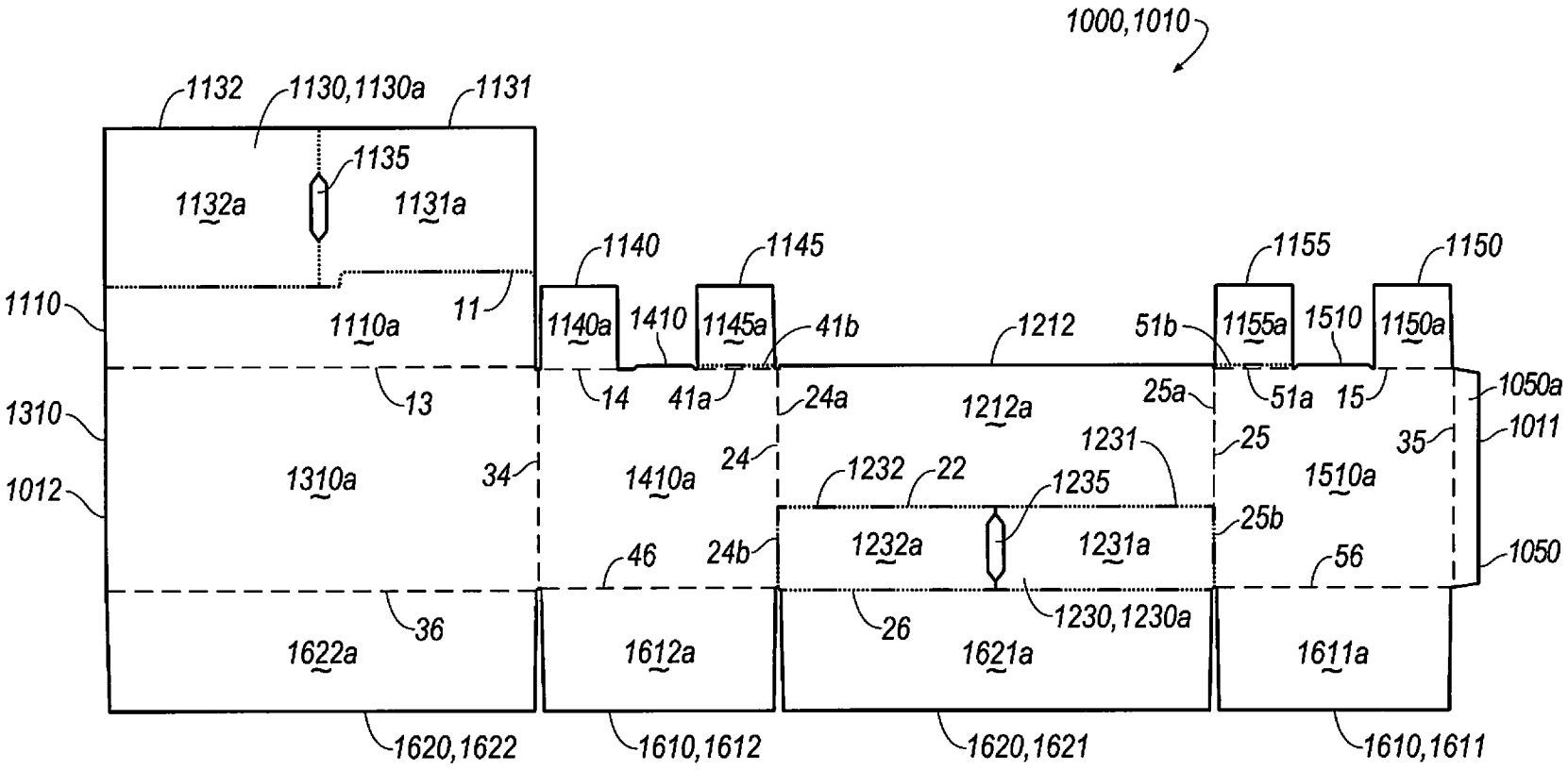
FIG. 8 is a plan view of a sheet of material used to form a dual merchandizing case in accordance with the principles of the present disclosure.
Figure 9:
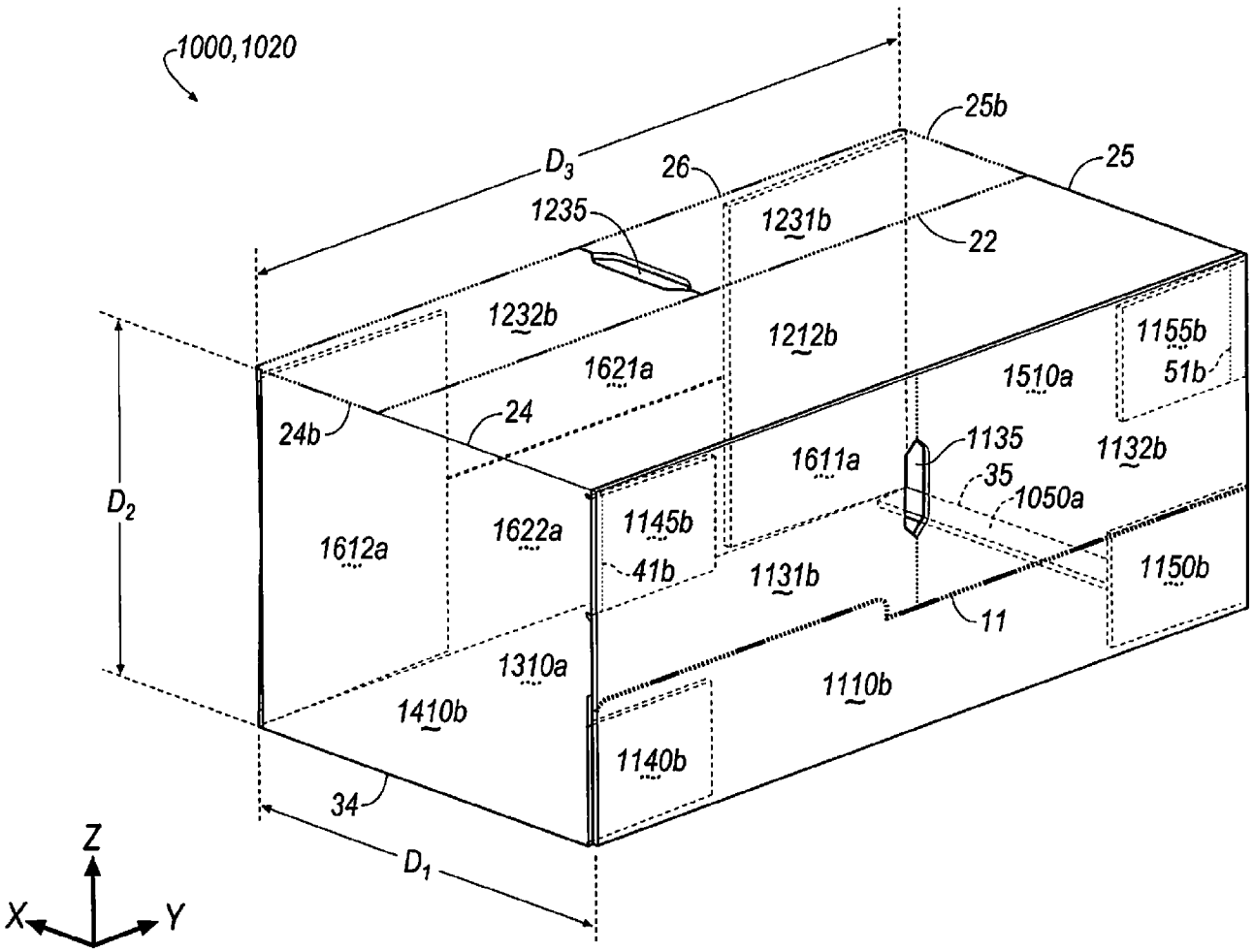
FIG. 9 is a perspective view of the merchandizing case of FIG. 8 in an erected state.

Referring to FIG. 8-11, in some implementations of the merchandising case 1000 of the present disclosure, the merchandizing case 1000 may include more than one tear-away panel. In this manner, the merchandizing case 1000, after its erection (as shown in FIG. 9), may not include an opening.

Referring specifically to FIG. 8, the merchandizing case 1000 takes the pre-erected state 1010 of an integral sheet of material. As previously discussed, the merchandizing case 1000 of FIG. 8 could have a different shape or size than what is illustrated without deviating from the design of this disclosure.

The pre-erected state 1010 of the merchandizing case 1000 of FIG. 8 extends from a first end 1011 to a second end 1012. When the merchandizing case 1000 takes its erected state 1020, the first end 1011 of the merchandizing case 1000 attaches to the second end 1012 of the merchandizing case 1000. Additionally, the sixth face 1600 of the merchandizing case 1000 of FIG. 8 is formed by two minor flaps 1610 and two major flaps 1620 when the merchandizing case 1000 takes its erected state 1020.

The exemplary implementation of the merchandizing case 1000 shown in FIG. 8 includes an end flap 1050 at the first end 1011 of the pre-erected state 1010 of the merchandizing case 1000. When the merchandizing case 1000 takes its erected state 1020, the end flap 1050 adheres to the panel 1310 of the third face 1300 of the merchandizing case 1000 to attach the first end 1011 of the merchandizing case 1000 to the second end 1012 of the merchandizing case 1000. However, the first end 1011 of the merchandizing case 1000 may attach to the second end 1012 of the merchandizing case 1000 in a different manner without deviating from the design of this disclosure. For example, the shape or size of the end flap 1050 may deviate from what is illustrated in FIG. 8, the end flap 1050 may connect to the panel 1310 in a different fashion, or the merchandizing case 1000 may not include an end flap 1050 at its first end 1011. If the case 1000 does not include an end flap 1050 located at its first end 1011, a similar end flap 1050 could be included at the second end 1012 of the pre-erected state 1010 of the merchandizing case 1000.

A panel 1510 of the fifth face 1500 connects to the end flap 1050 at a scoring line 35. A first lip-supporting flap 1150 connects to the panel 1510 at a scoring line 15. A severable third support flap 1155 connects to the panel 1510 at a scoring line 51*a*. A first minor flap 1611 connects to the panel 1510 at a scoring line 56. The scoring line 15 is located at an edge of the panel 1510 that also includes the scoring line 51*a*. The edge of the panel 1510 that includes the scoring line 15 and the scoring line 51*a* opposes an edge of the panel 1510 at which the scoring line 56 is located.

A tear-line 51*b* is formed into the severable third support flap 1155 parallel to and directly adjacent the scoring line 51*a*. The tear-line 51*b* includes a predetermined area of weakness, which may be created utilizing perforations formed into the material of the severable third support flap 1155. In other examples, the predetermined area of weakness forming the tear-line 51*b* may be implemented as a cut line, an alternation between cut lines and perforations, or any other implementation allowing easy severance along the path of the predetermined area of weakness of the tear-line 51*b*. If perforations create the predetermined area of weakness of the tear-line 51*b*, the perforations may include a series of punctures to allow easy separation along the path of the perforations. Additionally, the location of the tear-line 51*b* may differ from what is shown in FIG. 8 without deviating from the design of this disclosure. For example, the tear-line 51*b* may be formed elsewhere into the severable third support flap 1155 or may be formed on the other side of scoring line 51*a* into the panel 1510 of the fifth face 1500. Finally, the entire severable third support flap 1155 may not exist or may be connected to a face other than the fifth face 1500. For example, the third support flap 1155 may be connected to the second presentation face 1200 at the edge of the display wall 1212 opposing the tear-line 22, without deviating from the disclosure.

A display wall 1212 and a tear-away panel 1230 are formed from the panel 1210 of the second presentation face 1200. The display wall 1212 and the tear-away panel 1230 connect to the panel 1510 of the fifth face 1500 at a scoring line 25. Particularly, the panel 1510 of the fifth face 1500 connects to the display wall 1212 at a first segment 25*a* of the scoring line 25 and the panel 1510 of the fifth face 1500 connects to the tear-away panel 1230 at a second segment 25*b* of the scoring line 25. The second segment 25*b* of the scoring line 25 includes a predetermined area of weakness, which may be created utilizing perforations formed into the material of the merchandizing case 1000. In other examples, the predetermined area of weakness disposed along the second segment 25*b* of the scoring line 25 may be implemented as a cut line, an alternation between cut lines and perforations, or any other implementation allowing easy severance along the second segment 25*b* of the scoring line 25. If perforations create the predetermined area of weakness along the second segment 25*b* of the scoring line 25, the perforations may include a series of punctures to allow easy separation along the path of the perforations. When the tear-away panel 1230 removed from the case 1000, the tear-away panel 1230 detaches from the panel 1510 by severing the second segment 25*b* of the scoring line 25. However, when severance of the second segment 25*b* of the scoring line 25 occurs, the first segment 25*a* of the scoring line 25 does not sever and the display wall 1212 remains connected to the panel 1510.

A first major flap 1621 connects to the tear-away panel 1230 at a scoring line 26 disposed adjacent to the first minor flap 1611 that is connected to panel 1510 of the fifth face 1500. The scoring line 26 includes a predetermined area of weakness, which may be created utilizing perforations formed into the material of the merchandizing case 1000. In other examples, the predetermined area of weakness along the scoring line 26 may be implemented as a cut line, an alternation between cut lines and perforations, or any other implementation allowing easy severance along the scoring line 26. If perforations create the predetermined area of weakness along the scoring line 26, the perforations may include a series of punctures to allow easy separation along the path of the perforations. Normally, the tear-away panel 1230 is not removed until after the merchandizing case 1000 is in its erected state 1020 (as shown in FIGS. 5-6), at which time the tear-away panel 1230 detaches from the first major flap 1621 by severing the scoring line 26. Following severance of the scoring line 26, the first major flap 1621 remains in place as a result of its connection to the two minor flaps 1610, which partially forms the sixth face 1600 of the merchandizing case 1000.

A tear-line 22, which extends across the panel 1210 of the second presentation face 1200, delineates the border between the display wall 1212 and the tear-away panel 1230. The tear-line 22 includes a predetermined area of weakness, which may be created utilizing perforations formed into the material of the panel 1210 of the second presentation face 1200 of the merchandizing case 1000. In other examples, the predetermined area of weakness forming the tear-line 22 may be implemented as a cut line, an alternation between cut lines and perforations, or any other implementation allowing easy severance along the path of the predetermined area of weakness of the tear-line 22. If perforations create the predetermined area of weakness of the tear-line 22, the perforations may include a series of punctures to allow easy separation along the path of the perforations.

The tear-away panel 1230 has a shape defined by the tear-line 22, the second segment 25*b* of the scoring line 25, the scoring line 26, and a second segment 24*b* of scoring line 24. The tear-away panel 1230 includes a first removable tab 1231, a second removable tab 1232, and a pull hole 1235 that divides the tear-away panel 1230 into the first removable tab 1231 and the second removable tab 1232. The pull hole 1235 may be formed such that the pull hole 1235 extends partially into each panel 1230, 1231 or, alternatively, into only one of the panels 1230, 1231. The tear-away panel 1230 may be implemented in a different fashion without deviating from the disclosure. For example, the tear-away panel 1230 may only include a single tab with a pull hole 1235 disposed adjacent either the second segment 25*b* of the scoring line 25 or the second segment 24*b* of the scoring line 24. Alternatively, the tear-away panel 1230 may not include a pull hole 1235, in which case the tear-away panel 1230 may be removed by utilizing a pull tab. Finally, the merchandizing case 1000 may not include a tear-away panel 1230, in which case an opening may be formed into the second presentation face 1200 of the merchandizing case 1000 at the location in FIG. 8 where the tear-away panel 1230 is shown.

A panel 1410 of the fourth face 1400 connects to the display wall 1212 and the tear-away panel 1230 at a scoring line 24. Particularly, the panel 1410 of the fourth face 1400 connects to the display wall 1212 at a first segment 24*a* of the scoring line 24 and the panel 1410 of the fourth face 1400 connects to the tear-away panel 1230 at a second segment 24*b* of the scoring line 24. A second lip-supporting flap 1140 connects to the panel 1410 at a scoring line 14. A severable fourth support flap 1145 connects to the panel 1410 at a scoring line 41*a*. A second minor flap 1612 connects to the panel 1410 at a scoring line 46 located adjacent to the first major flap 1621. The scoring line 14 is located at an edge of the panel 1410 that also includes the scoring line 41*a*. The edge of the panel 1410 that includes the scoring line 14 and the scoring line 41*a* opposes an edge of the panel 1410 at which the scoring line 46 is located.

A tear-line 41*b* is formed into the severable fourth support flap 1145 parallel to and directly adjacent the scoring line 41*a*. The tear-line 41*b* includes a predetermined area of weakness, which may be created utilizing perforations formed into the material of the severable fourth support flap 1145. In other examples, the predetermined area of weakness forming the tear-line 41*b* may be implemented as a cut line, an alternation between cut lines and perforations, or any other implementation allowing easy severance along the path of the predetermined area of weakness of the tear-line 41*b*. If perforations create the predetermined area of weakness of the tear-line 41*b*, the perforations may include a series of punctures to allow easy separation along the path of the perforations. Additionally, the location of the tear-line 41*b* may differ from what is shown in FIG. 8 without deviating from the disclosure. For example, the tear-line 41*b* may be formed elsewhere into the severable fourth support flap 1145 or may be formed on the other side of scoring line 41*a* into the panel 1410 of the fourth face 1400. Finally, the severable fourth support flap 1145 may not exist or may be connected to a face other than the fourth face 1400. For example, the fourth support flap 1145 may be as connected to the second presentation face 1200 at an edge of the display wall 1212 opposing the tear-line 22, without deviating from the disclosure.

The second segment 24*b* of the scoring line 24 includes a predetermined area of weakness, which may be created utilizing perforations formed into the material of the merchandizing case 1000. In other examples, the predetermined area of weakness along the second segment 24*b* of the scoring line 24 may be implemented as a cut line, an alternation between cut lines and perforations, or any other implementation allowing easy severance along the second segment 24*b* of the scoring line 24. If perforations create the predetermined area of weakness along the second segment 24*b* of the scoring line 24, the perforations may include a series of punctures to allow easy separation along the path of the perforations. When the tear-away panel 1230 is removed from the case 1000, the tear-away panel 1230 detaches from the panel 1410 by severing the second segment 24*b* of the scoring line 24. However, when severance of the second segment 24*b* of the scoring line 24 occurs, the first segment 24*a* of the scoring line 24 does not sever and the display wall 1212 remains connected to the panel 1410 of the fourth face 1400.

A panel 1310 of the third face 1300 connects to the panel 1410 of the fourth face 1400 at a scoring line 34. An edge of the panel 1310 of the third face 1300 opposing the scoring line 34 forms the second end 1012 of the pre-erected state 1010 of the merchandizing case 1000. A presentation lip 1110 connects to the panel 1310 of the third face 1300 at a scoring line 13. A second major flap 1622 connects to the panel 1310 of the third face 1300 at a scoring line 36 adjacent to the second minor flap 1612 that connects to the panel 1410 of the fourth face 1400. The scoring line 13 is located at an edge of the panel 1310 that opposes an edge of the panel 1310 at which the scoring line 36 is located.

In addition to the presentation lip 1110, the first presentation face 1100 of the merchandizing case 1000 in its pre-erected state 1010 also includes a tear-away panel 1130 that attaches to the presentation lip 1110 at a tear-line 11. The tear-line 11 is includes a predetermined area of weakness, which may be created utilizing perforations formed into the material of the first presentation face 1100 of the merchandizing case 1000. In other examples, the predetermined area of weakness forming the tear-line 11 may be implemented as a cut line, an alternation between cut lines and perforations, or any other implementation allowing easy severance along the path of the predetermined area of weakness of the tear-line 11. If perforations create the predetermined area of weakness of the tear-line 11, the perforations may include a series of punctures to allow easy separation along the path of the perforations.

The tear-away panel 1130 of the first presentation face 1100 includes a first removable tab 1131, a second removable tab 1132, and a pull hole 1135 that divides the tear-away panel 1130 into the first removable tab 1131 and the second removable tab 1132. The tear-away panel 1130 may be implemented in a different fashion without deviating from the design of this disclosure. For example, the tear-away panel 1130 may only include a single tab with a pull hole 1135 located either at an edge of the tear-away panel 1130 adjacent to the second end 1012 of the merchandizing case 1000 when in the pre-erected state 1010 or at an edge of the tear-away panel 1130 opposing the edge adjacent the second end 1012 of the merchandizing case 1000 when in the pre-erected state 1010. Alternatively, the tear-away panel 1130 may not include a pull hole 1135. Rather, the tear-away panel 1130 may be removed from the case 1000 by utilizing a pull tab or by grasping an edge of the tear-away panel 1130.

FIG. 8 illustrates the inner surface of the merchandizing case 1000 when the case 1000 is in the pre-erected state 1010. The opposing, outer surface of the merchandising case when in the pre-erected state 1010 *o* is not shown. In FIG. 8, the inner surface 1050*a* of the end flap 1050, the inner surface 1510*a* of the panel 1510 of the fifth face 1500, the inner surface 1212*a* of the display wall 1212, the inner surface 1230*a* of the tear-away panel 1230 (and the inner surfaces 1231*a*, 1232*a* of the two removable tabs 1231, 1232 formed from the tear-away panel 1230), the inner surface 1410*a* of the panel 1410 of the fourth face 1400, the inner surface 1310*a* of the panel 1310 of the third face 1300, the inner surfaces 1611*a*, 1612*a*, 1621*a*, 1622*a* of the minor flaps 1610 and the major flaps 1620, the inner surfaces 1140*a*, 1150*a* of the lip-supporting flaps 1140, 1150, the inner surfaces 1145*a*, 1155*a* of the severable support flaps 1145, 1155, the inner surface 1110*a* of the presentation lip 1110, and the inner surface 1130*a* of the tear-away panel 1130 (and the inner surface 1131*a*, 1132*a* of the two removable tabs 1131, 1132 formed from the tear-away panel 1130) are shown. The outer surface 1050*b* of the end flap 1050, the outer surface 1510*b* of the panel 1510 of the fifth face 1500, the outer surface 1212*b* of the display wall 1212, the outer surface 1230*b* of the tear-away panel 1230 (and the outer surfaces 1231*b*, 1232*b* of the two removable tabs 1231, 1232 formed from the tear-away panel 1230), the outer surface 1410*b* of the panel 1410 of the fourth face 1400, the outer surface 1310*b* of the panel 1310 of the third face 1300, the outer surfaces 1611*b*, 1612*b*, 1621*b*, 1622*b* of the minor flaps 1610 and the major flaps 1620, the outer surface 1140*b*, 1150*b* of the lip-supporting flaps 1140, 1150, the outer surfaces 1145*b*, 1155*b* of the severable support flaps 1145, 1155, the outer surface 1110*b* of the presentation lip 1110, and the outer surface 1130*b* of the tear-away panel 1130 (and the outer surface 1131*b*, 1132*b* of the two removable tabs 1131, 1132 formed from the tear-away panel 1130) are not shown in FIG. 8.

Any of the faces of the merchandizing case 1000 may include additional features that are not illustrated in FIG. 8 without deviating from the design of this disclosure. Such additional features may include hand-holes, sensory holes, handling tabs, or any other desired feature. Although the merchandizing case 1000 of this disclosure may include such features, such features are not required features of the design of this disclosure and are not illustrated in the figures.

The merchandizing case is capable of being erected from the pre-erected state 1010 (as shown in FIG. 8) of an integral sheet of material into the erected state 1020 (as shown in FIG. 9). To begin erection of the merchandizing case 1000, the merchandizing case 1000 is creased along scoring lines 24, 25, 34, and 35. The first end 1011 of the merchandizing case 1000 is attached to the second end 1012 of the merchandizing case 1000 when the outer surface 1050*b* of the end flap 1050 is adhered to the inner surface 1310*a* of the panel 1310 of the third face 1300. At this point, the panel 1310 of the third face 1300 opposes the display wall 1212 and the removable tabs 1231, 1232 of the second presentation face 1200 and the panel 1410 of the fourth face 1400 opposes the panel 1510 of the fifth face 1500.

Next, the scoring lines 13, 14, 15, 41*a*, and 51*a* (shown in FIG. 8) are creased. The outer surface 1150*b* of the first lip-supporting flap 1150 and the outer surface 1140*b* of the second lip-supporting flap 1140 are each adhered to the inner surface 1110*a* of the presentation lip 1110, the outer surface

1155*b* of the severable third support flap 1155 is adhered to the inner surface 1132*a* of the second removable tab 1132 of the tear-away panel 1130, and the outer surface 1145*b* of the severable fourth support flap 1145 is adhered to the inner surface 1131*a* of the first removable tab 1131 of the tear-away panel 1130. In this fashion, the first presentation face 1100 is formed as a substantially closed face formed by the presentation lip 1110 and the tear-away panel 1130 (as illustrated in FIG. 9).

Finally, the scoring lines 26, 36, 46, 56 (shown in FIG. 8) are creased. The outer surface 1611*b* of the first minor flap 1611 and the outer surface 1612*b* of the second minor flap 1612 are each adhered to the inner surface 1621*a*, 1622*a* of each the first major flap 1621 and the second major flap 1622. In this fashion, the two minor flaps 1610 and the two major flaps 1620 substantially enclose the sixth face 1600 of the merchandizing case 1000 (as illustrated by hidden lines in FIG. 9).

Following its erection, the merchandizing case 1000 takes its erected state 1020 as illustrated in FIG. 9. In its erected state 1020, the merchandizing case 1000 encloses an interior volume $V_{1000}$ (shown in FIG. 11) and has a first dimension $D_1$, a second dimension $D_2$, and a third dimension $D_3$. The first presentation face 1100 and the sixth face 1600 both reside in a plane of the second dimension $D_2$ and the third dimension $D_3$ and oppose each other at a distance defined in the first dimension $D_1$. The second presentation face 1200 and the third face 1300, which are both located adjacent to the first presentation face 1100, both reside in a plane of the first dimension $D_1$ and the third dimension $D_3$ and oppose each other at a distance defined in the second dimension $D_2$. The fourth face 1400 and the fifth face 1500, which are both located adjacent to the first presentation face 1100, both reside in a plane of the first dimension $D_1$ and the second dimension $D_2$ and oppose each other at a distance defined in the third dimension $D_3$.

The tear-away panel 1130 of the first presentation face 1100 of the merchandizing case of FIG. 9 is adhered to and held in place by the severable third support flap 1155 and the severable fourth support flap 1145 when the merchandizing case 1000 is in the erected state 1020. The presentation lip 1110 of the first presentation face 1100 of the merchandizing case of FIG. 9 is adhered to and held in place by the first lip-supporting flap 1150 and the second lip-supporting flap 1140 when the merchandizing case 1000 is in the erected state 1020.

Figure 10:
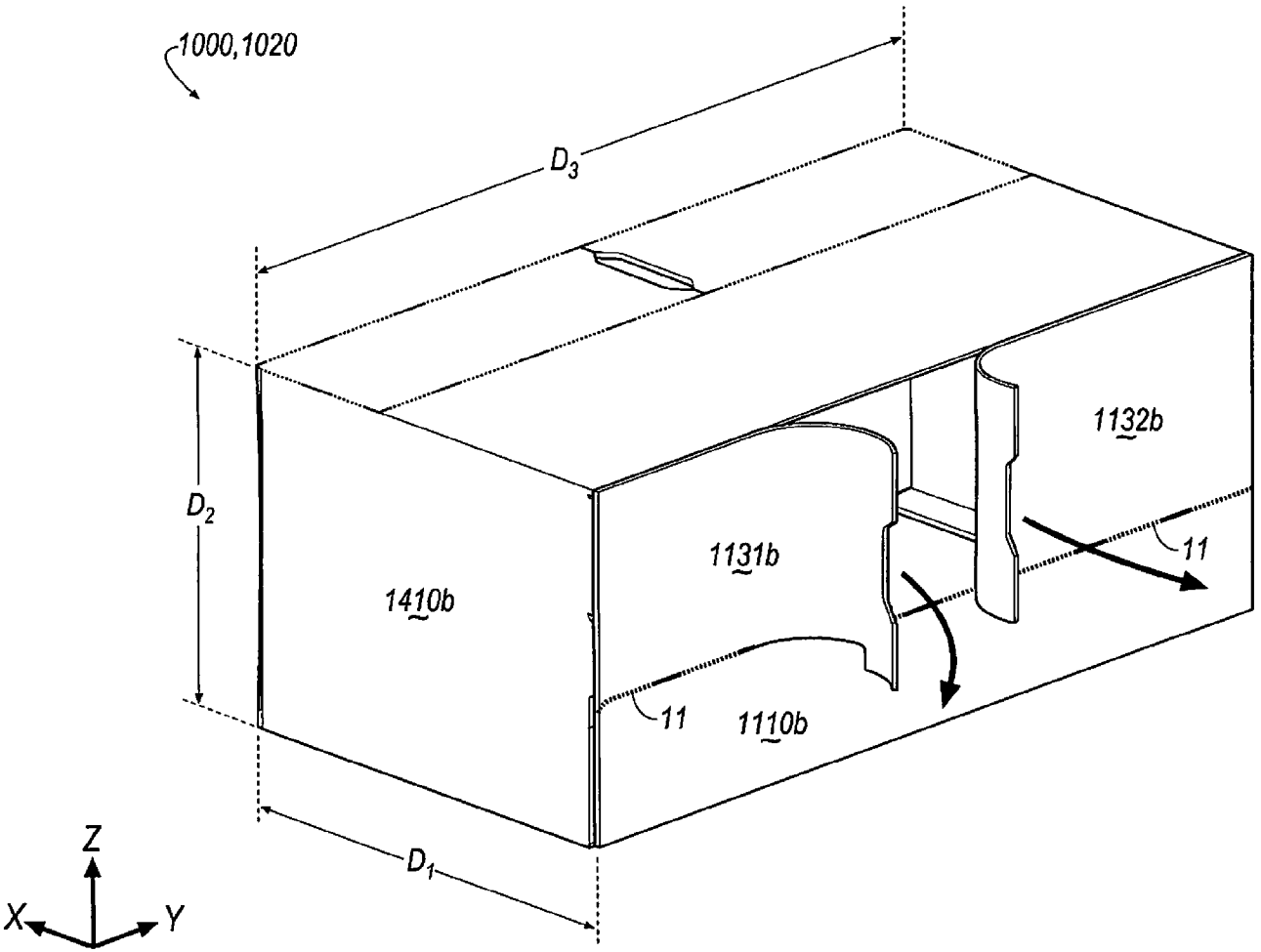
FIG. 10 is a perspective view of the merchandizing case of FIG. 8 in an erected state and having an opening formed in a first presentation face.
Figure 11:
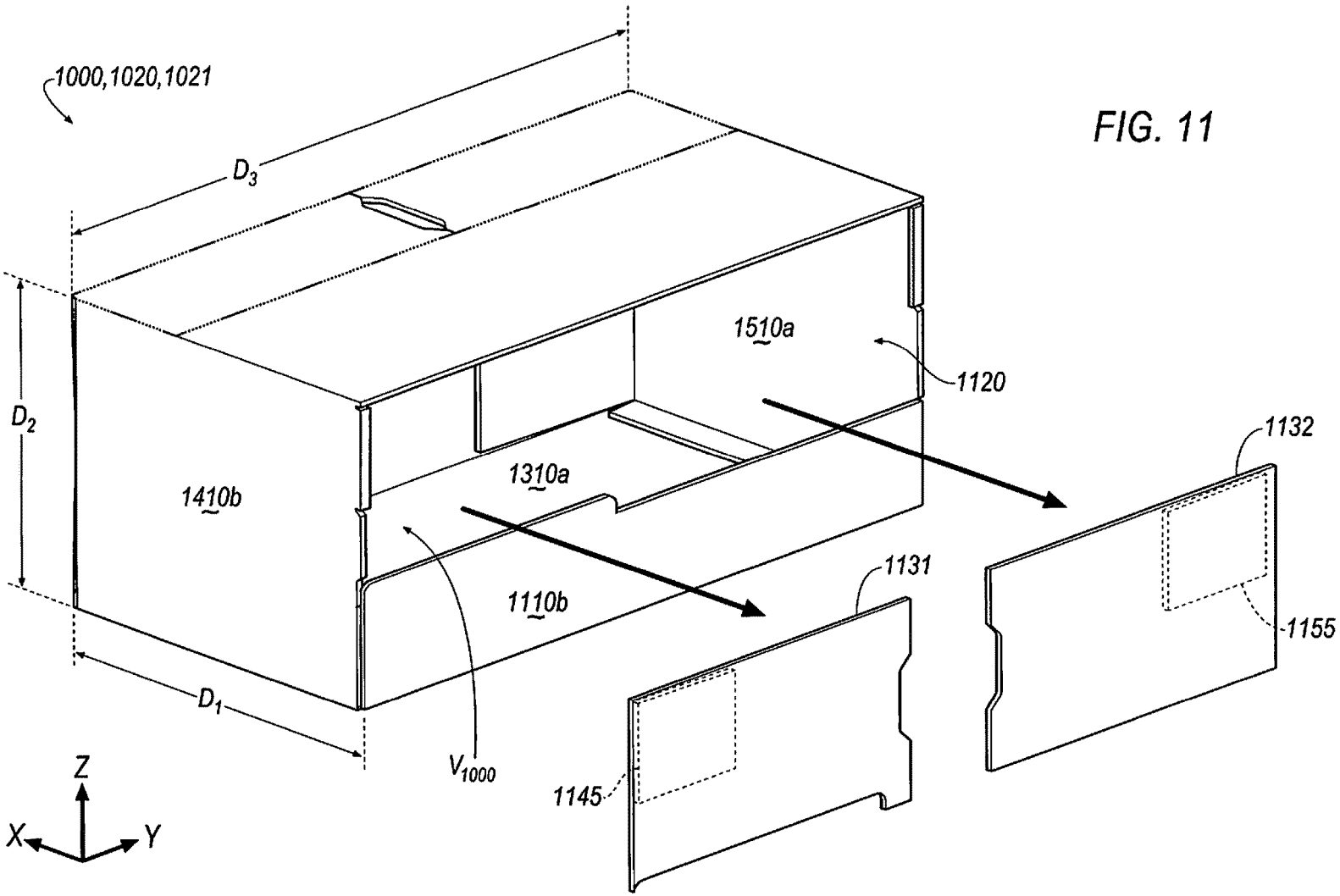
FIG. 11 is a perspective view of the merchandizing case of FIG. 8 in its erected state and in a first utilization position.

Referring to FIGS. 10-11, before the erected state 1020 of the merchandizing case 1000 of FIG. 9 can be utilized in its first position 1021 (as shown in FIG. 4A-4C), the tear-away panel 1130 of the first presentation face 1100 must be detached to create the display opening 1120. Referring specifically to FIG. 10, a user may access the tear-away panel 1130 via the pull hole 1135 to allow the user to apply a force on the tear-away panel 1130 in a longitudinal x-direction and a transverse y-direction to begin detaching the first removable tab 1131 and the second removable tab 1132 of the tear-away panel 1130 from the merchandizing case 1000. Detaching the first removable tab 1131 and the second removable tab 1132 from the case 1000 is accomplished by severing the predetermined areas of weakness along the tear-line 11.

Referring specifically to FIG. 11, once the tear-line 11 is fully severed, the first removable tab 1131 remains attached to the panel 1410 of the fourth face 1400 due to the adherence of the first removable tab 1131 to the severable fourth support flap 1145 and the second removable tab 1132 remains attached to the panel 1510 of the fifth face 1500 due to the adherence of the second removable tab 1132 to the severable third support flap 1155. Accordingly, the tear-line 41*b* is severed to fully detach the first removable tab 1131 and the severable fourth support flap 1145 from the panel 1410 of the fourth face 1400 and the tear-line 51*b* is severed to fully detach the second removable tab 1132 and the severable third support flap 1155 from the panel 1510 of the fifth face 1500. Detachment of the first removable tab 1131 and the second removable tab 1132 creates a display opening 1120 in the first presentation face 1100 of the merchandizing case 1000 to access the interior volume $V_{1000}$. After formation of the display opening 1120, the merchandizing case 1000 of FIG. 9 (or of any other implementation of the disclosure that includes a tear-away panel 1130 at the first presentation face 1100) is substantially similar to the merchandizing case 1000 of FIGS. 1A-1B and the merchandizing case 1000 of FIGS. 4A-4C. Accordingly, the erected state 1020 of the merchandizing case 1000 of FIG. 11 may be utilized in its first position 1021 and may receive product 2000 (not shown) within its interior volume $V_{1000}$ that is retained by the presentation lip 1110. The process to utilize the merchandizing case 1000 of FIG. 11 in its second position 1022 is similar to the steps previously described and illustrated in FIGS. 5, 6, and 7A-7C. Accordingly, a description of the use of the merchandising case 1000 in the second position 1022 is foregone.

Although FIGS. 10-11 describe the tear-away panel 1130 of the first presentation face 1100 as being removed from the merchandising case 1000 in order for the erected state 1020 of the merchandizing case 1000 of FIG. 9 to be utilized in its first position 1021 prior to removing the tear-away panel 1230 of the second presentation face 1200, the tear-away panel 1230 of the second presentation face 1200 could be removed from the case 1000 before the tear-away panel 1130 of the first presentation face 1100 is removed. Accordingly, the merchandizing case 1000 of FIG. 9 could reside in its second position 1022 prior to the formation of the opening 1120 in the first presentation face 1100.

A number of implementations have been described. Nevertheless, it will be understood that various modifications may be made without departing from the spirit and scope of the disclosure. Accordingly, other implementations are within the scope of the following claims.

What is claimed is:

1. A merchandizing case comprising:

a housing having a first wall, a second wall, a third wall, a fourth wall, a fifth wall, and a sixth wall, said first wall opposing and substantially parallel to said sixth wall, said third wall opposing and substantially parallel to said second wall, and said fifth wall opposing and substantially parallel to said fourth wall, said housing having an interior volume defined by said first wall, said second wall, said third wall, said fourth wall, said fifth wall, and said sixth wall;

a first dispensing opening formed in said first wall to provide access to said interior volume, said first dispensing opening usable when said housing is supported by said third wall;

a second dispensing opening formed in said second wall to provide access to said interior volume, said second dispensing opening usable when said housing is supported by said sixth wall;

a tear-away panel of said first wall movable from a first state restricting access to said interior volume via said first dispensing opening and a second state permitting access to said interior volume via said first dispensing opening, said tear-away panel including a first removable tab and a second removable tab;

a first severable support flap extending from said fourth wall and attached to said first removable tab; and a second severable support flap extending from said fifth wall and attached to said second removable tab, wherein when said tear-away panel is moved to said second state said first severable support flap is fully detached from said fourth wall and said second severable support flap is fully detached from said fifth wall.

2. The merchandising case of claim 1, further comprising a first display formed on said first wall adjacent to said first dispensing opening.

3. The merchandising case of claim 2, wherein said first wall extends from said third wall toward said second wall, said first wall being interrupted by said first dispensing opening.

4. The merchandising case of claim 1, wherein said first dispensing opening is disposed at a junction of said first wall and said second wall.

5. The merchandising case of claim 4, wherein said second dispensing opening is disposed at a junction of said sixth wall and said second wall.

6. The merchandising case of claim 1, wherein said first dispensing opening extends between said fifth wall and said fourth wall.

7. The merchandising case of claim 6, wherein said first dispensing opening extends to said second wall.

8. The merchandising case of claim 1, wherein said second dispensing opening extends to said fifth wall and said fourth wall.

9. The merchandising case of claim 8, wherein said second dispensing opening extends to said sixth wall.

10. The merchandising case of claim 1, further comprising a second display formed on said second wall adjacent to said second dispensing opening.

11. A merchandizing case comprising:

a housing having a first wall, a second wall, a third wall, a fourth wall, a fifth wall, and a sixth wall, said first wall opposing and substantially parallel to said sixth wall, said third wall opposing and substantially parallel to said second wall, and said fifth wall opposing and substantially parallel to said fourth wall, said housing having an interior volume defined by said first wall, said second wall, said third wall, said fourth wall, said fifth wall, and said sixth wall;

a first dispensing opening formed in said first wall to provide access to said interior volume;

a second dispensing opening formed in said second wall to provide access to said interior volume;

a first tear-away panel movable from a first state restricting access to said interior volume via said first dispensing opening and a second state permitting access to said interior volume via said first dispensing opening opening, said first tear-away panel including a first removable tab having a first severable support flap extending from said fourth wall, and a second removable tab having a second severable support flap extending from said fifth wall; and a second tear-away panel moveable from a second state restricting access to said interior volume via said second dispensing opening and a fourth state permitting access to said interior volume via said second dispensing opening, said second tear-away panel including a third removable tab having a first cutout and a fourth removable tab having a second cutout, said first cutout cooperating with said second cutout to provide an access hole that facilitates moving said second tear-away panel from said third state to said fourth state, wherein upon the occurrence of said first tear-away panel being in said second state said first severable support flap is fully detached from said fourth wall and said second severable support flap is fully detached from said fifth wall.

12. The merchandising case of claim 11, further comprising a first display formed on said first wall adjacent to said first dispensing opening.

13. The merchandising case of claim 12, wherein said first wall extends from said second wall toward said third wall, said first wall being interrupted by said first dispensing opening.

14. The merchandising case of claim 11, wherein said first dispensing opening is disposed at a junction of said first wall and said second wall.

15. The merchandising case of claim 14, wherein said second dispensing opening is disposed at a junction of said sixth wall and said second wall.

16. The merchandising case of claim 11, wherein said first dispensing opening extends between said fifth wall and said fourth wall.

17. The merchandising case of claim 16, wherein said first dispensing opening extends to said second wall.

18. The merchandising case of claim 11, wherein said second dispensing opening extends to said fifth wall and said fourth wall.

19. The merchandising case of claim 18, wherein said second dispensing opening extends to said sixth wall.

20. The merchandising case of claim 11, further comprising a second display formed on said second wall adjacent to said second dispensing opening.

* * * * *